US009882323B2

(12) United States Patent
Tziviskos et al.

(10) Patent No.: US 9,882,323 B2
(45) Date of Patent: Jan. 30, 2018

(54) FLEXIBLE CONNECTOR RECEPTACLES

(71) Applicant: Apple Inc., Cupertino, CA (US)

(72) Inventors: George Tziviskos, Cupertino, CA (US); Paul J. Hack, San Jose, CA (US); Matthew W. Blum, San Francisco, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 14/683,122

(22) Filed: Apr. 9, 2015

(65) Prior Publication Data

US 2015/0295356 A1 Oct. 15, 2015

Related U.S. Application Data

(60) Provisional application No. 61/979,469, filed on Apr. 14, 2014, provisional application No. 62/001,060, filed on May 21, 2014, provisional application No. 62/129,826, filed on Mar. 7, 2015.

(51) Int. Cl.

| | |
|---|---|
| ***H01R 13/52*** | (2006.01) |
| ***H01R 24/64*** | (2011.01) |
| ***H01R 13/6585*** | (2011.01) |
| *H01R 107/00* | (2006.01) |
| *H01R 13/6581* | (2011.01) |
| *H01R 13/6582* | (2011.01) |

(52) U.S. Cl.
CPC ..... *H01R 24/64* (2013.01); *H01R 13/6585* (2013.01); *H01R 13/6581* (2013.01); *H01R 13/6582* (2013.01); *H01R 2107/00* (2013.01)

(58) Field of Classification Search
CPC ..... H01R 13/5202; H01R 13/519; H01R 13/6585
USPC ..... 439/271–275
See application file for complete search history.

(56) References Cited

U.S. PATENT DOCUMENTS 3,539,973 A * 11/1970 Wright ..... H01R 13/7197 333/182
5,267,868 A 12/1993 Wolff, Jr.
6,884,094 B1 * 4/2005 Bernhart ..... H01R 13/28 439/101

(Continued)

FOREIGN PATENT DOCUMENTS

CN 201 285 872 8/2009
EP 2 590 273 A2 5/2013

(Continued)

OTHER PUBLICATIONS

International Search Report and Written Opinion dated Dec. 16, 2015, 16 pages.

(Continued)

*Primary Examiner* — Briggitte R Hammond
(74) *Attorney, Agent, or Firm* — Kilpatrick Townsend & Stockton, LLP

(57) ABSTRACT

Connector receptacles that are able to withstand insertion and other forces, are reliable, and are easy to manufacture. One example may provide a connector receptacle having one or more movable portions. These movable portions may move relative to an enclosure for an electronic device housing the connector receptacle. When a connector insert is inserted into the receptacle, the movable portions may move to help absorb insertion forces thereby protecting the connector receptacle from damage.

20 Claims, 20 Drawing Sheets

(56) References Cited

U.S. PATENT DOCUMENTS

| | | | | |
|---|---|---|---|---|
| 7,922,535 | B1 * | 4/2011 | Jiang | H01R 13/5205 439/271 |
| 9,093,779 | B1 * | 7/2015 | Wang | H01R 13/521 |
| 9,350,121 | B2 | 5/2016 | Ju | |
| 9,509,084 | B2 * | 11/2016 | Zhao | H01R 13/5202 |
| 9,531,113 | B2 * | 12/2016 | Ohyama | H01R 13/5205 |
| 2002/0149875 | A1 * | 10/2002 | Dague | G11B 5/4806 360/99.16 |
| 2009/0163071 | A1 | 6/2009 | Chen | |
| 2009/0190277 | A1 | 7/2009 | Hiew et al. | |
| 2010/0055986 | A1 | 3/2010 | Wang et al. | |
| 2011/0159747 | A1 | 6/2011 | Tung et al. | |
| 2011/0195606 | A1 | 8/2011 | Hsia | |
| 2011/0230074 | A1 | 9/2011 | Schmidt | |
| 2013/0143441 | A1 | 6/2013 | Huang et al. | |
| 2013/0244494 | A1 | 9/2013 | Tziviskos et al. | |
| 2013/0288520 | A1 | 10/2013 | Simmel et al. | |
| 2013/0330976 | A1 | 12/2013 | Simmel et al. | |
| 2014/0073184 | A1 | 3/2014 | Zhao et al. | |
| 2014/0099835 | A1 | 4/2014 | Chang | |
| 2015/0162684 | A1 | 6/2015 | Amini et al. | |
| 2015/0171562 | A1 | 6/2015 | Gao et al. | |
| 2015/0200493 | A1 | 7/2015 | Gao et al. | |
| 2015/0263465 | A1 | 9/2015 | Zhang | |
| 2015/0270661 | A1 * | 9/2015 | Kao | H01R 13/5202 439/271 |
| 2015/0295362 | A1 | 10/2015 | Tziviskos et al. | |
| 2015/0340782 | A1 | 11/2015 | Amini et al. | |
| 2015/0340783 | A1 | 11/2015 | Lee et al. | |
| 2015/0340813 | A1 | 11/2015 | Ng et al. | |
| 2015/0340825 | A1 | 11/2015 | Ng et al. | |

FOREIGN PATENT DOCUMENTS

| | | | |
|---|---|---|---|
| JP | 2003-059586 | A | 2/2003 |
| JP | 2013-118165 | A | 6/2013 |
| JP | 2013-522846 | A | 6/2013 |
| KR | 10-2010-0050530 | | 5/2010 |
| WO | 2009/017599 | A | 2/2009 |

OTHER PUBLICATIONS

First Examination Report dated Mar. 17, 2016 for AU Patent Application No. 2016100014, 4 pages.

Office Action (English Translation) dated Jul. 29, 2016 in Korean Patent Application No. 20-2015-0002381, 4 pages.

Office Action (English Translation) dated Aug. 1, 2016 in Korean Patent Application No. 20-2015-0002378, 4 pages.

Office Action (English Translation) dated Jun. 23, 2017 in Korean Patent Application No. 20-2015-0002378, 3 pages.

Autralian Office Action dated Jun. 10, 2015 for AU Patent Application No. 2015100481, 4 pages.

First Action Interview Pilot Communication Pre-Interview Communication dated Sep. 21, 2017 in U.S. Appl. No. 14/683,134, 5 pages.

* cited by examiner

FLEXIBLE CONNECTOR RECEPTACLES

CROSS-REFERENCES TO RELATED APPLICATIONS

This application claims the benefit of U.S. provisional applications No. 61/979,469, filed on Apr. 14, 2014, No. 62/001,060, filed May 21, 2014, and No. 62/129,826, filed Mar. 7, 2015, each titled "DURABLE CONNECTOR RECEPTACLES," which are incorporated by reference.

BACKGROUND

The amount of data transferred between electronic devices has grown tremendously the last several years. Large amounts of audio, streaming video, text, and other types of data content are now regularly transferred among desktop and portable computers, media devices, handheld media devices, displays, storage devices, and other types of electronic devices.

Power may be transferred with this data, or power may be transferred separately. Power and data may be conveyed over cable assemblies. Cable assemblies may include a cable that may have wire conductors, fiber optic cables, or some combination of these or other conductors. Cable assemblies may also include a connector insert at each end of the cable, though other cable assemblies may be connected or tethered to an electronic device in a dedicated manner. The connector inserts may be inserted into receptacles in the communicating electronic devices.

During these insertions, a user inserting a connector insert may exert a force in the direction of insertion into the receptacle. Also, the direction of insertion may be somewhat tilted or rotated. This force may exert compression and angular forces on one or more portions of the connector receptacle. This force may damage the connector receptacle causing a reduction or loss of functionality of the electronic device housing the connector receptacle. Similar forces may be exerted on one or more portions of a connector receptacle after a connector insert has been inserted in the receptacle or during extraction of a connector insert from the receptacle.

Also, these connector inserts may be inserted into a device receptacle one or more times a day for multiple years. It may be desirable that these connector inserts be reliable and do not break or wear down prematurely, since such failures may lead to user dissatisfaction with the electronic device.

Electronic devices may be sold in the millions, with an attendant number of connector receptacles sold with them. With such volumes, any reduction or simplification in the manufacturing of a connector receptacle becomes significant. For such reasons, it may be desirable that these connector receptacles are readily manufactured.

Thus, what is needed are connector receptacles that are able to withstand insertion and other forces, are reliable, and are easy to manufacture.

SUMMARY

Accordingly, embodiments of the present invention may provide connector receptacles that are able to withstand insertion and other forces, are reliable, and are readily manufactured. An exemplary embodiment of the present invention may provide a connector receptacle having one or more movable portions. These movable portions may move relative to an enclosure or portion of an enclosure for an electronic device housing the connector receptacle. When a connector insert is inserted into, extracted from, or subject to force after insertion into the receptacle, the movable portions may move to help absorb insertion forces, thereby protecting the connector receptacle from damage. The movable portions may further include self-aligning features such that the movable portions self-align back to an original position in the absence of force. While these techniques are well-suited to use in connector receptacles, they may also be employed in connector inserts, or both connector inserts and receptacles, consistent with embodiments of the present invention. Also, while embodiments of the present invention may protect connector receptacles from damage during the insertion of a connector insert, embodiments of the present invention may also protect connector receptacles from damage during an extraction of a connector insert and from damage caused by forces being applied to a connector insert or connector receptacle while the connector insert is positioned inside the connector receptacle. Embodiments of the present invention may also protect connector receptacles from damage by unrelated items at other times. Throughout this document damage that may occur at any of these or other times may be referred to as damage caused during the insertion of a connector insert for clarity.

In a specific embodiment of the present invention, a connector receptacle having a movable tongue may be provided. The tongue may move front-to-back along an axis of insertion. This may help to protect the tongue during the insertion of a connector insert. The tongue may also move in forward, up, down, side-to-side, pitch, yaw, and roll directions. This may help to protect the tongue during insertions where a connector insert is not directly inserted into the receptacle, but is instead inserted in an offset or rotated direction. This may be of particular importance when the tongue is exceptionally thin and would otherwise be prone to damage. In other embodiments of the present invention, various portions of a connector receptacle, such as housings, tongues, contacts, shields, and the like, may move together or separately relative to a device enclosure or portion of an enclosure. For example, a housing and a tongue may be able to move together or separately relative to a device enclosure or portion of an enclosure.

In a specific embodiment of the present invention, a connector receptacle may include a tongue located in an opening in a housing. The housing may be a portion of a device enclosure, or it may be separate from the device enclosure. The tongue may be attached to the opening in the housing by a pliable or flexible gasket or grommet. This flexible gasket or grommet may flex to allow the tongue to move during an insertion. In this and other embodiments of the present invention, the tongue may be further attached through one or more other gaskets or grommets to one or more other structures attached to or formed as part of the device enclosure, a printed circuit board in the enclosure, or other structure in the electronic device. For example, the tongue may attach to one or more rods or posts through one or more other gaskets or grommets. These rods or posts may, in turn, attach to the device enclosure, a printed circuit board in the device enclosure, or other structure in or associated with the device enclosure. In still other embodiments of the present invention, rods, posts, screws, or other structures may be located in one or more openings in the tongue. These structures may be located in the openings in way to apply pressure against the grommet to hold the grommet in place against a device enclosure. In this embodiment, the tongue may include one or more tabs to secure the grommet in place between the tabs and the device enclosure. As before, each of these gaskets or grommets may flex to allow the tongue to move in forward, backward, up, down, side-to-side, pitch, yaw, and roll directions.

In various embodiments of the present invention, these gaskets or grommets may be formed of various materials. For example, these gaskets or grommets may be formed using elastomers with low compression set. This may help to ensure consistent performance over the life of the connector receptacle. In specific embodiments of the present invention, the elastomers used may be silicone or urethane. In various embodiments of the present invention, the gasket or grommets may be conductive. This may be useful in providing a ground or power path through the gasket or grommet.

In still other embodiments of the present invention, other gaskets or grommets may be used. For example, a tongue may pass through an opening in a printed circuit board, and a gasket or grommet may be used to attach the two. In still other embodiments, the tongue itself may be part of a printed circuit board in an electronic device. The printed circuit board may then be attached through grommets to posts or other structures that may, in turn, be attached to a device enclosure, a second printed circuit board, or other structure in or associated with the electronic device.

In various embodiments of the present invention, various components may be placed on such a flexible tongue. For example, electronic components and circuits may be placed on the tongue. Other connectors may be used to connect the tongue to a printed circuit board, flexible circuit board, or other structure in an electronic device housing the tongue. Traces or interconnect lines may connect contacts on the tongue to these components, circuits, connectors, and other structures or devices.

In various embodiments of the present invention, contacts, ground contacts, metallic pieces, and other conductive portions of a connector receptacle, such as the shell or shield, may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions may be formed using injection or other molding, 3-D printing, machining, or other manufacturing process. The nonconductive portions may be formed of silicon or silicone, rubber, hard rubber, plastic, nylon, liquid-crystal polymers (LCPs), ceramics, or other nonconductive material or combination of materials. Again, the gaskets or grommets may be formed of various materials including, but not limited to, elastomers with low compression set. This may help to ensure consistent performance over the life of the connector receptacle. In specific embodiments of the present invention, the elastomers used may be silicone or urethane. The printed circuit boards used may be formed of FR-4 or other material. Printed circuit boards may be replaced by other substrates, such as flexible circuit boards, in many embodiments of the present invention.

Embodiments of the present invention may provide connector receptacles that may be located in and may connect to various types of devices, such as portable computing devices, tablet computers, desktop computers, laptops, all-in-one computers, cell phones, smart phones, media phones, storage devices, portable media players, navigation systems, monitors, power supplies, adapters, remote control devices, chargers, and other devices. These connector receptacles may provide pathways for signals and power compliant with various standards such as Universal Serial Bus (USB), a High-Definition Multimedia Interface (HDMI), Digital Visual Interface (DVI), power, Ethernet, DisplayPort, Thunderbolt, Lightning and other types of standard and non-standard interfaces that have been developed, are being developed, or will be developed in the future.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
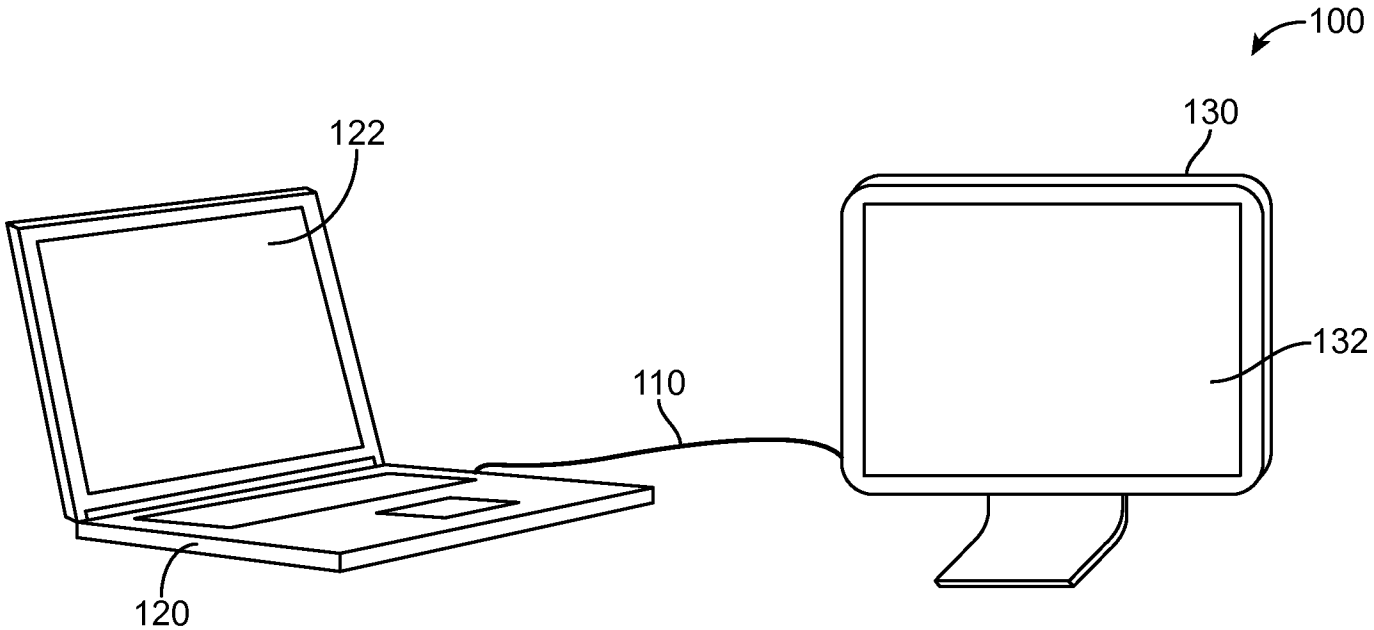
FIG. 1 illustrates an electronic system that may be improved by the incorporation of embodiments of the present invention.

FIG. 1 illustrates an electronic system that may be improved by the incorporation of embodiments of the present invention. This figure, as with the other included figures, is shown for illustrative purposes and does not limit either the possible embodiments of the present invention or the claims.

Electronic system 100 may include cable 110 joining electronic devices 120 and 130. In this example, electronic device 120 may be a laptop or portable computer having screen 122. Electronic device 130 may be a monitor 130 that may include screen 132. In other embodiments of the present invention, cable 110 may couple various types of devices, such as portable computing devices, tablets, desktop computers, all-in-one computers, cell phones, smart phones, media phones, storage devices, portable media players, navigation systems, monitors power supplies, adapters, and chargers, and other devices. These cables, such as cable 110, may provide pathways for signals and power compliant with various standards such as Universal Serial Bus (USB), a High-Definition Multimedia Interface (HDMI), Digital Visual Interface (DVI), power, Ethernet, DisplayPort, Thunderbolt, Lightning and other types of standard and non-standard interfaces that are either presently developed, under development, or will be developed in the future. Cable 110 may attach to electronic devices 110 and 130 through connector receptacles provided by embodiments of the present invention.

Figure 2:
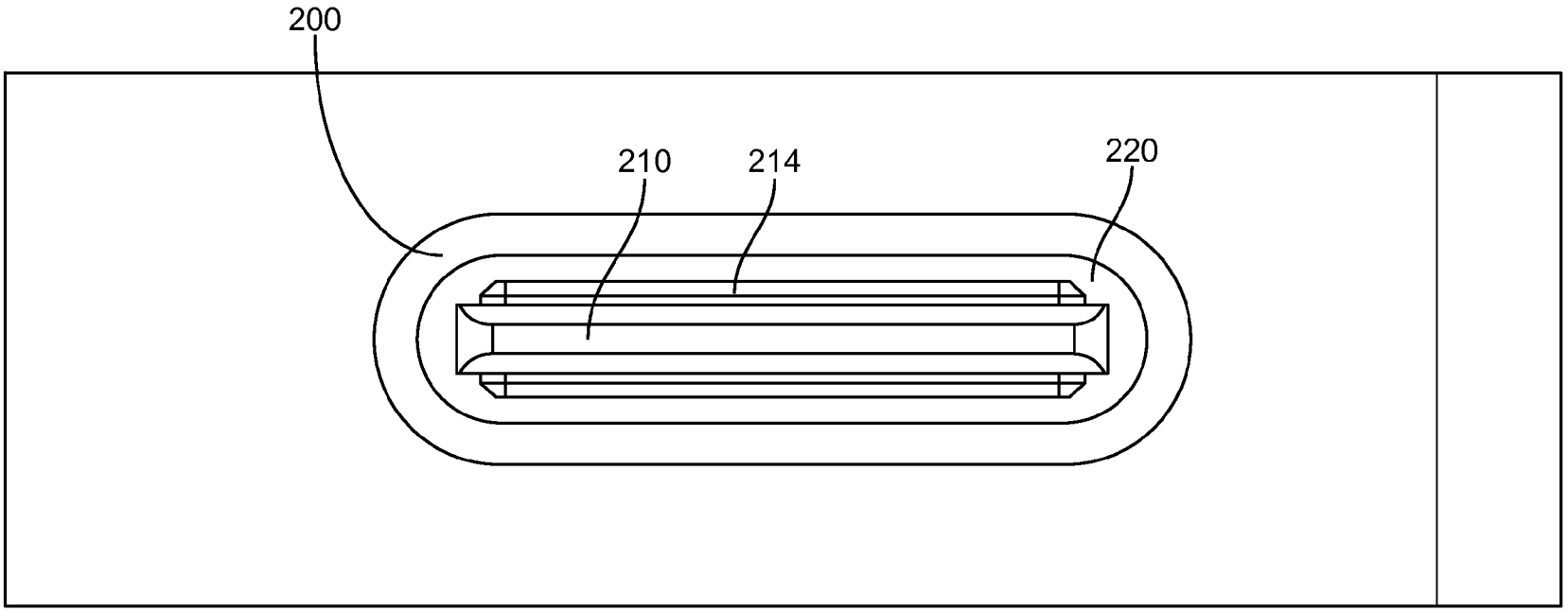
FIG. 2 illustrates a front view of a connector receptacle according to an embodiment of the present invention.

FIG. 2 illustrates a front view of a connector receptacle according to an embodiment of the present invention. This connector receptacle may include tongue 210 in opening of device enclosure 200. Tongue 210 may support one or more ground contacts 214. Tongue 210 may emerge into the connector receptacle through rear wall 220 in device enclosure 200.

In this and other embodiments of the present invention, a front of tongue 210 may be chamfered for easier insertion into an opening in a connector insert. This chamfered opening may be coated to reduce wear on the front surface of tongue 210 that may be caused by repeated insertions of a connector insert.

In various embodiments of the present invention, tongue 210 or other portions of this connector receptacle may be reinforced to prevent damage during the insertion of a connector insert. These tongues may be located in openings in device enclosures, they may be located in connector receptacle housings separate from device enclosures, or they may be located in other structures. An example of such a connector system is shown in the following figure.

Figure 3:
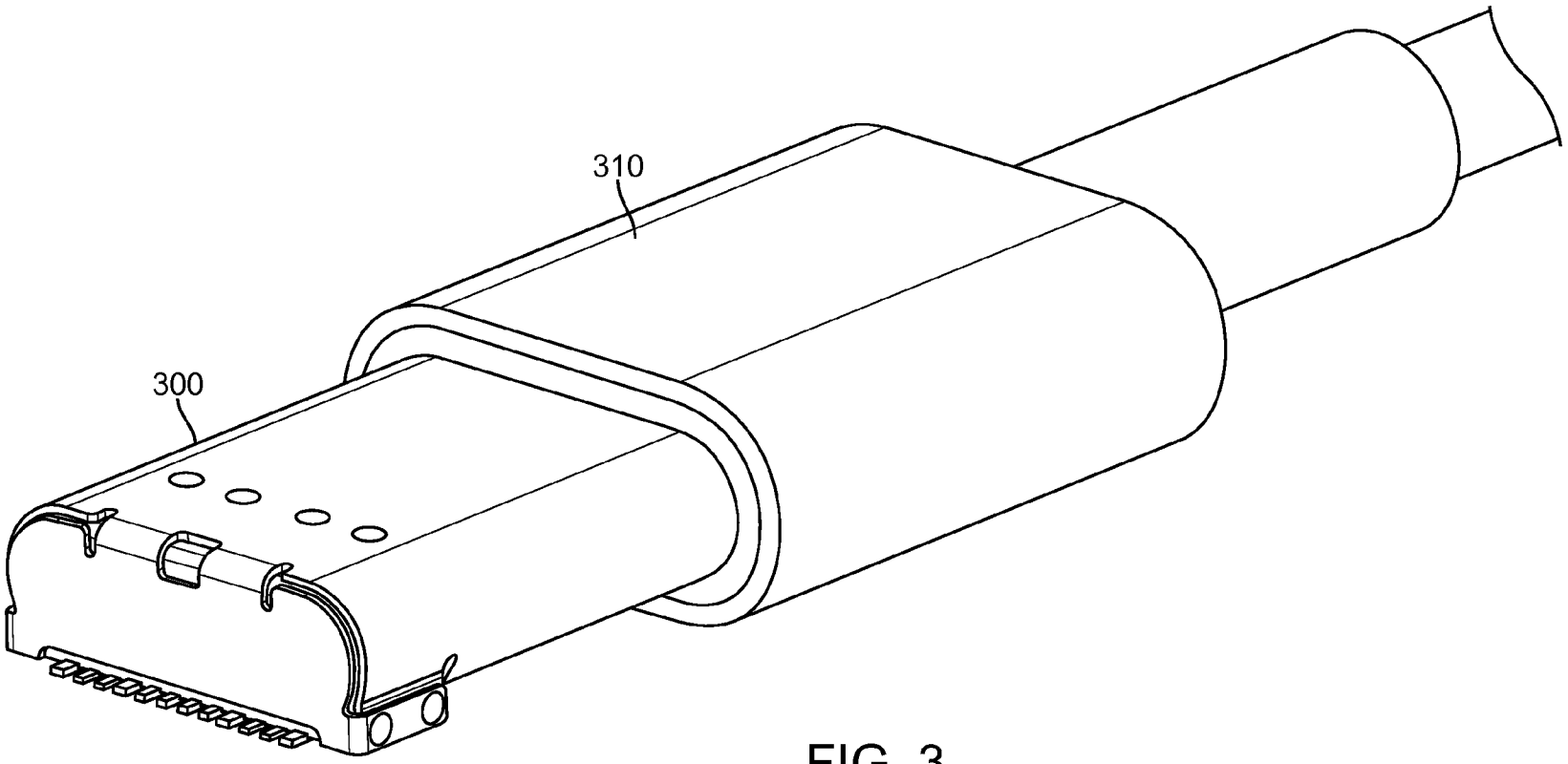
FIG. 3 illustrates a connector system where a connector insert is inserted into a connector receptacle according to an embodiment of the present invention.

FIG. 3 illustrates a connector insert according to embodiments of the present invention that is been inserted into a connector receptacle according to an embodiment of the present invention. Specifically, connector insert 310 has been inserted into connector receptacle 300. Receptacle 300 may be located in various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. Connector insert 310 and receptacle 300, as with the other included connector inserts and connector receptacles, may provide pathways for signals that are compliant with various standards such as one of the Universal Serial Bus (USB) standards including USB-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. In other embodiments of the present invention, connector insert 310 and receptacle 300 may be used to provide a reduced set of functions for one or more of these standards. In various embodiments of the present invention, these interconnect paths provided by connector insert 310 and receptacle 300 may be used to convey power, ground, signals, test points, and other voltage, current, data, or other information. More information about connector insert 310 may be found in co-pending U.S. patent application Ser. No. 14/543,711, filed Nov. 17, 2014, titled CONNECTOR RECEPTACLE HAVING A SHIELD, which is incorporated by reference.

Figure 4:
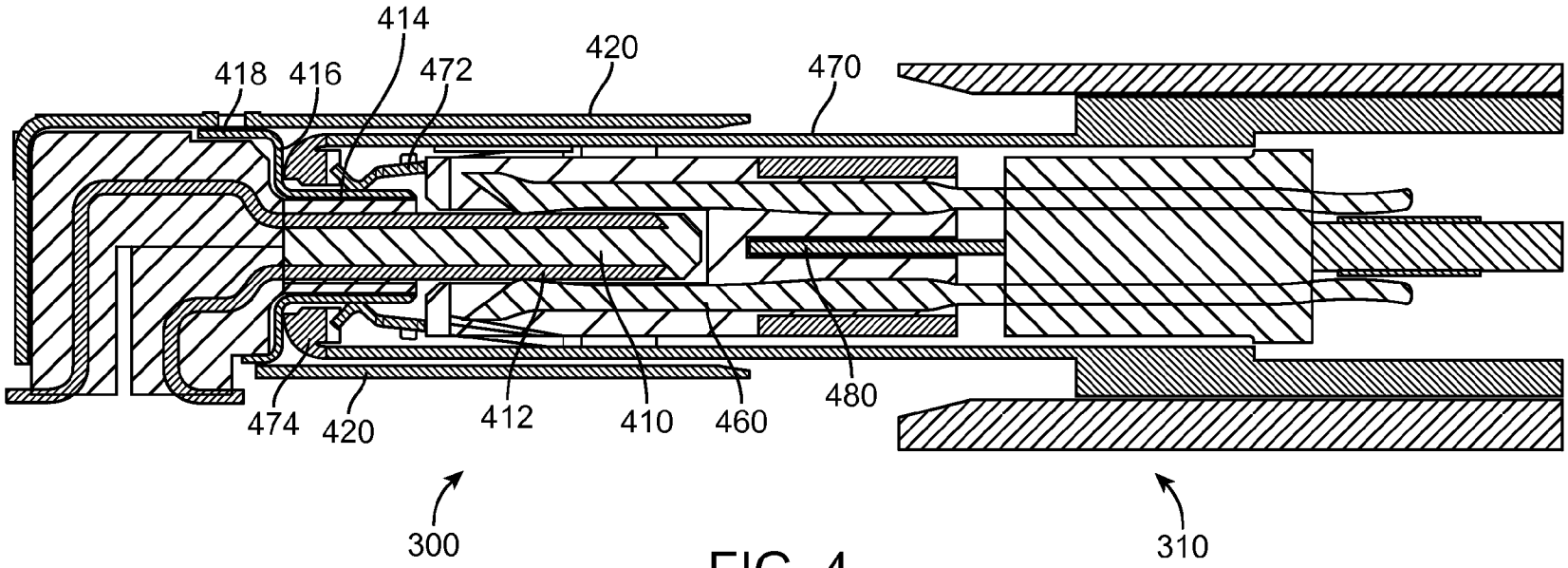
FIG. 4 illustrates a cutaway side view of a connector system according to an embodiment of the present invention.

FIG. 4 illustrates a cutaway side view of a connector system according to an embodiment of the present invention. This example may illustrate structures and functionality that may be included in the other examples shown herein and other embodiments of the present invention. The receptacle 300 may be the same or similar in structure or functionality as receptacle of FIG. 2, FIG. 8, or any of the other receptacles shown herein. In this example, connector receptacle 300 may include tongue 410 supporting a number of contacts 412. As before, ground contacts 414 may be located on tongue 410. Ground contacts 414 may be stepped to include vertical portion 416 and horizontal portion 518. Horizontal portion 418 may contact receptacle shield 420.

Connector insert 310 may include shield 470 surrounding contacts 460. Shield 470 may be electrically connected to ground contacts 472. Shield 470 may terminate in end pieces 474. Tongue 410 may include a central ground plane or portion (not shown), while the connector insert may include ground plane or portion 480.

This arrangement may provide shielding for signal paths formed by contacts 412 and 460. Specifically, connector insert shield 470 may electrically contact receptacle shield 420. Receptacle shield 420 may electrically connect to ground contact 414 through vertical portion 416 and horizontal portion 418. Ground contact 472 in the connector insert may electrically contact ground contacts 414 and connector insert shield 470. Ground planes and ground portions in tongue 410 and ground plane or portions 480 in the connector insert may electrically connect to each other and these other structures as well. In various embodiments of the present invention, end pieces 474 may be conductive, and may thus form electrical connections with vertical portions 416. This shielding may help to isolate signals on contacts 412 and 460 from each other and from circuits, traces, and components external to this connector system.

Figure 5:
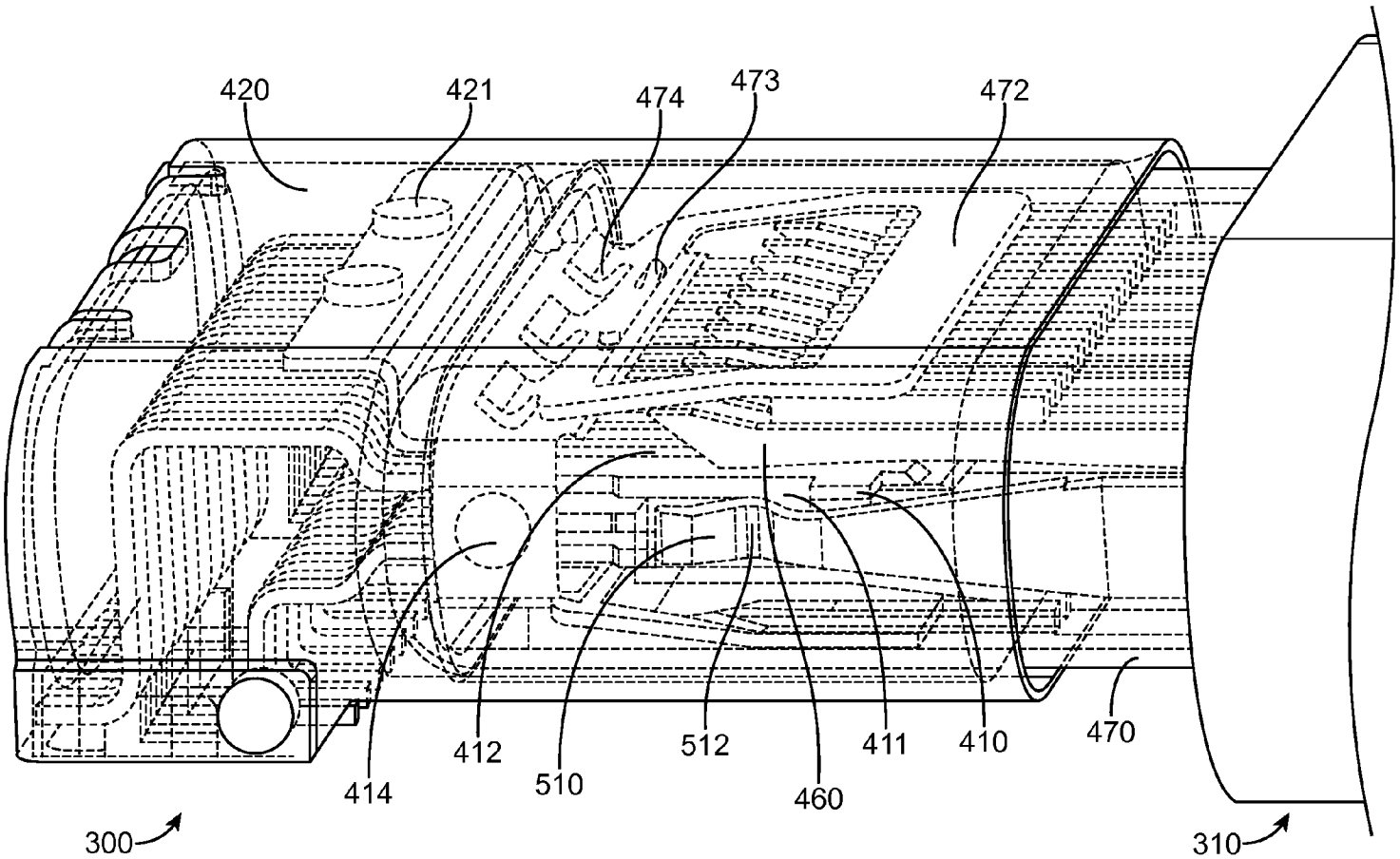
FIG. 5 illustrates a transparent oblique view of a connector system according to an embodiment of the present invention.

FIG. 5 illustrates a transparent oblique view of a connector system according to an embodiment of the present invention. This example may illustrate structures and functionality that may be included in the other examples shown herein and other embodiments of the present invention. In this example, connector insert 310 may be inserted into connector receptacle 300. Again, more detail on these and other connector inserts may be found in co-pending U.S. patent application Ser. No. 14/543,711, filed Nov. 17, 2014, titled CONNECTOR RECEPTACLE HAVING A SHIELD, which is incorporated by reference.

This connector system, as with the other included connector systems may perform at least three functions. The first is to convey signals between a connector insert and a connector receptacle. These signals may include power, ground, and data signals, such as audio and video signals. A second is to shield these signals while they are being transferred. This may prevent or reduce the corruption of the signals during transfer. A third is to provide a retention force such that the connector insert is not inadvertently removed from the connector receptacle. Such accidental extractions may be particularly undesirable during transfer of large files.

Signals may be transferred using pins 460 in the connector insert 310, which may mate with contacts 412 in receptacle 300.

These signals may be shielded in a number of ways. For example, shield 470 of connector insert 310 may electrically connect to ground piece 472 at finger 473. Ground contacts 474 at a front of connector insert 310 may contact a horizontal portion of ground piece 414 in connector receptacle 300. Ground piece 414 may electrically connect to connector receptacle shield 420 via connection points 421. Shield 420 of connector receptacle 300 may electrically connect to shield 470 on connector receptacle 300.

Retention may be provided by side ground contacts 112 engaging notches 125 on tongue 129. Specifically, side ground contacts 510 may include contacting portion 512, which may engage notches 411 on sides of tongue 410. Notches 411 may be plated and connected to ground in the connector receptacle 300, thereby forming another ground path with side ground contacts 510, which may be connected to ground through the connector insert 310.

In various embodiments of the present invention, varying amounts of retention force may be desired. Accordingly, side ground contacts 510 may be pre-biased such that they spring back to fit into notches 411 during insertion. The strength and thickness of side ground contacts 510 may also be adjusted to provide different retention forces for different applications. In some embodiments of the present invention, for example some docking stations, it may be desirable to provide zero retention force, in which case side ground contacts 510 may be omitted.

Again, these insertions may damage the connector receptacles. This may be particularly true when a connector insert is not inserted directly into the connector receptacle, but is instead inserted in a tilted or rotated direction. Damage may also be more likely when portions of a connector receptacle, such as a tongue, are small or thin. Accordingly, embodiments of the present invention may provide connector receptacles that are able to withstand these insertion forces. Again, while embodiments of the present invention may protect connector receptacles from damage during insertion of a connector insert, embodiments of the present invention may also protect connector receptacles from damage during extraction of a connector insert and from damage caused by forces being applied to a connector insert or connector receptacle while the connector insert is positioned inside the connector receptacle. Embodiments of the present invention may also protect connector receptacles from damage by unrelated items at other times. Throughout this document damage that may occur at any of these or other times may be referred to as damage caused during the insertion of a connector insert for clarity. Various embodiments of the present invention may employ flexible gaskets or grommets that may allow one or more portions of a connector receptacle to move relative to a device enclosure. An example is shown in the following figure.

Figure 6:
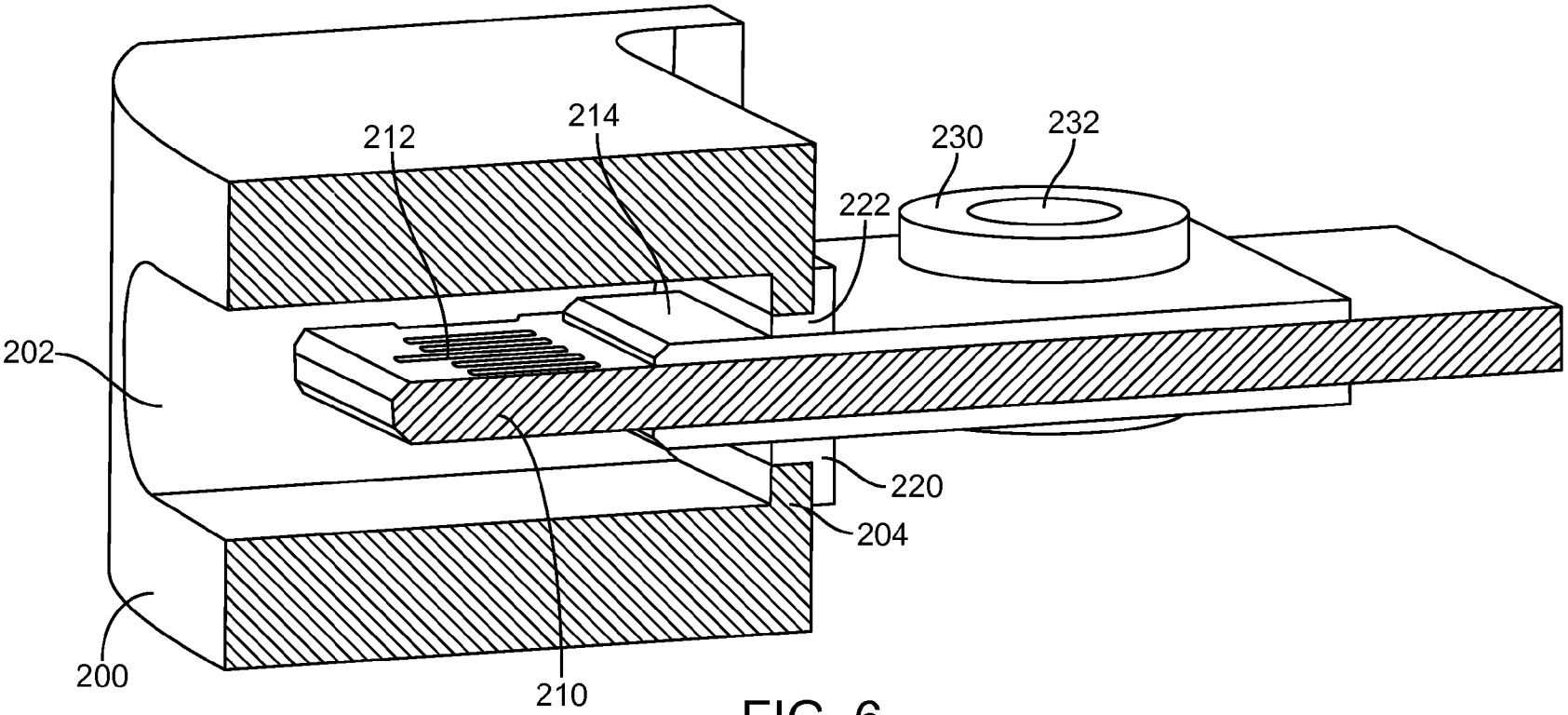
FIG. 6 illustrates a cutaway view of a connector receptacle according to an embodiment of the present invention.

FIG. 6 illustrates a cutaway view of a connector receptacle according to an embodiment of the present invention. This connector receptacle may include tongue 210 located in opening 202 of housing 200. A gasket or grommet may be located between tongue 210 and a back side 204 of enclosure 200. Specifically, the gasket or grommet may include a narrow portion 220 between tongue 210 and a back side 204 of device enclosure 200, as well as a wider back portion 220 behind the back side 204 of enclosure 200.

In various embodiments the present invention, an opening may be formed in tongue 210. A gasket or grommet 230 may be placed in the opening in tongue 210. The gasket or grommet 230 may have an opening 232. A rod, post, or other structure may be inserted into opening 232 of gasket or grommet 230. This rod or post may be attached to or formed as part of device enclosure 200, a printed circuit board located inside device enclosure 200, or other structure in, or associated with, the device enclosure 200.

These gaskets or grommets 220 and 230 may be flexible such that tongue 210 may move relative to device enclosure 200. For example, flexible gaskets or grommets 220 and 230 may allow tongue 210 to move backward into device enclosure 200 during the insertion of connector insert. This may help to relieve stress on tongue 210 during insertion, thereby helping to prevent damage. Flexible gaskets or grommets 220 and 230 may also allow tongue 210 to move in forward, up, down, side to side, pitch, yaw, and roll directions during the insertion and extraction of a connector insert. Again, this movement may protect tongue 210 during insertion, particularly during non-direct insertions, such as when the connector insert is inserted at a tilted or skewed angle.

Flexible gaskets or grommets 220 and 230 may be formed of various materials. For example, they may be formed using elastomers, such as silicone or urethane. They may be conductive to form ground paths, for example between ground contacts 214 and enclosure 200.

Tongue 210 may support a number of contacts 212. Contacts 212 may be located on a top side of tongue 210, on a bottom side of tongue 210, or on both top and bottom sides of tongue 210. Contacts 212 may form power and signal paths with corresponding contacts in a connector insert (not shown) when a connector insert is inserted in this connector receptacle.

Ground contacts 214 may be located on either or both a top and bottom side of tongue 210. Ground contacts 214 may form ground connections with corresponding ground contacts in a connector insert.

While in this example, tongue 210 is shown as being attached to enclosure 200 through grommet or gasket 220, in other embodiments of the present invention, tongue 210 may be attached through grommet or gasket 220 to a standalone connector receptacle housing separate from enclosure 200, or tongue 210 may be attached to another appropriate structure.

Figure 7:
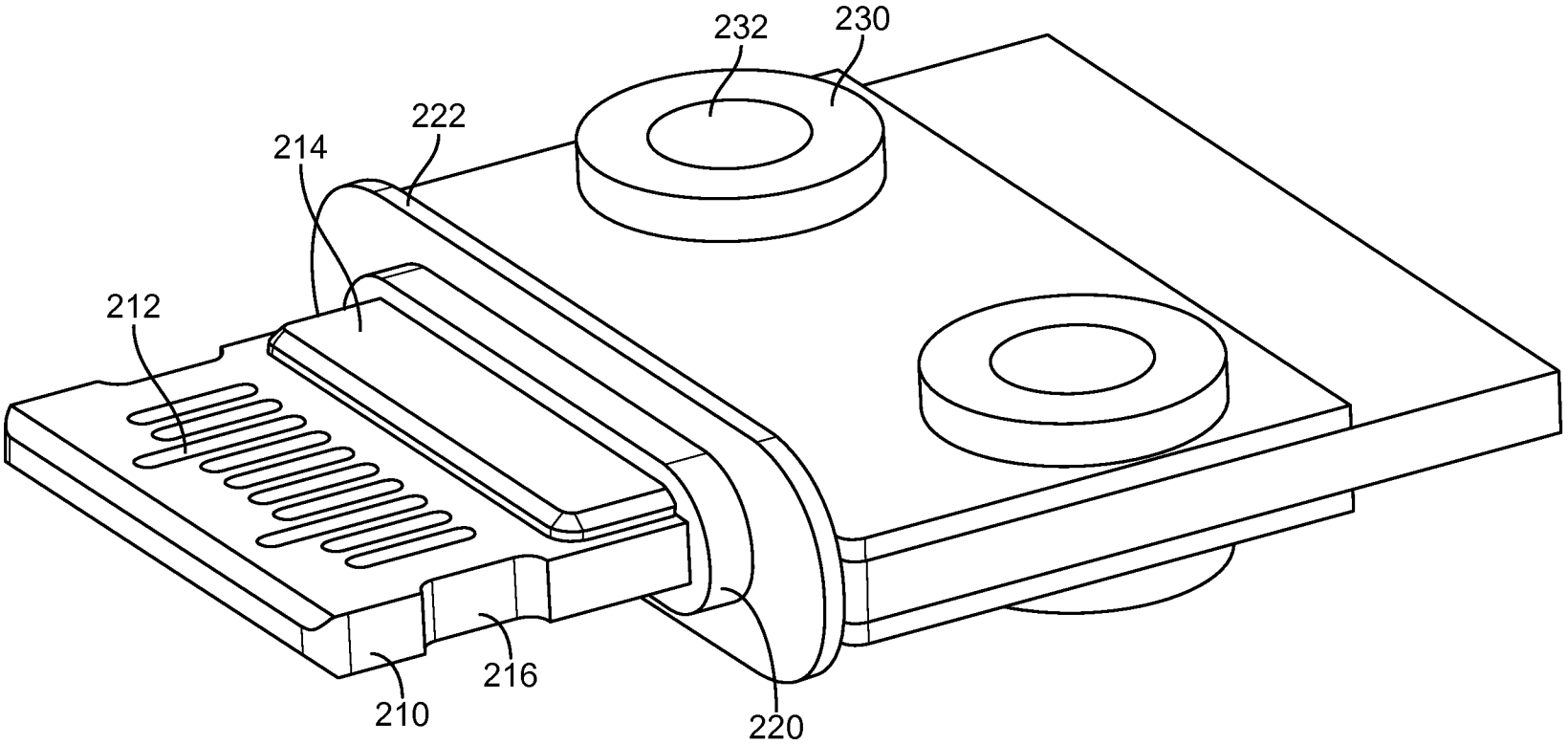
FIG. 7 illustrates a tongue for a connector receptacle according to an embodiment of the present invention.

FIG. 7 illustrates a tongue for a connector receptacle according to an embodiment of the present invention. While this and the other tongues shown here are well-suited for use in connector receptacles, in other embodiments of the present invention these tongues may be used in connector inserts.

As before, tongue 210 may support a number of contacts 212 and ground contacts 214. Grommets or gasket 220 may be wrapped around tongue 210, while grommets or gaskets 230 may be placed in openings in tongue 210. In other embodiments of the present invention, tongue 210 may have one, three, or more openings having grommets or gaskets 230. Also, in other embodiments the present invention, more than one gasket or grommet 220 may surround tongue 210. Tongue 210 may further include side cutout 216. Side cutout 216 may be used to accept a retention feature on a connector insert when the connector insert is inserted into a connector receptacle including this tongue.

In this example, a receptacle may include a tongue 210 attached to a device enclosure through one or more grommets or gaskets 220 and 230. In other embodiments of the present invention, tongue 210 may be attached to other structures in or associated with the electronic device. In other embodiments of the present invention, a receptacle may include a housing without a tongue. This housing may be attached to a device enclosure or other structure through one or more gaskets or grommets. In still other embodiments, a receptacle may include a tongue and a housing, where the tongue and housing may be attached to a device enclosure or other structure through one or more gaskets or grommets. In still other embodiments of the present invention, a tongue may be attached to a housing through one or more gaskets or grommets, while the housing may be attached to a device enclosure or other structure through one or more gaskets or grommets.

Another embodiment of the present invention may provide other connector receptacles tongues or other connector receptacle portions that may move relative to a device housing in order to protect the connector receptacle. An example is shown in the following figures.

Figure 8:
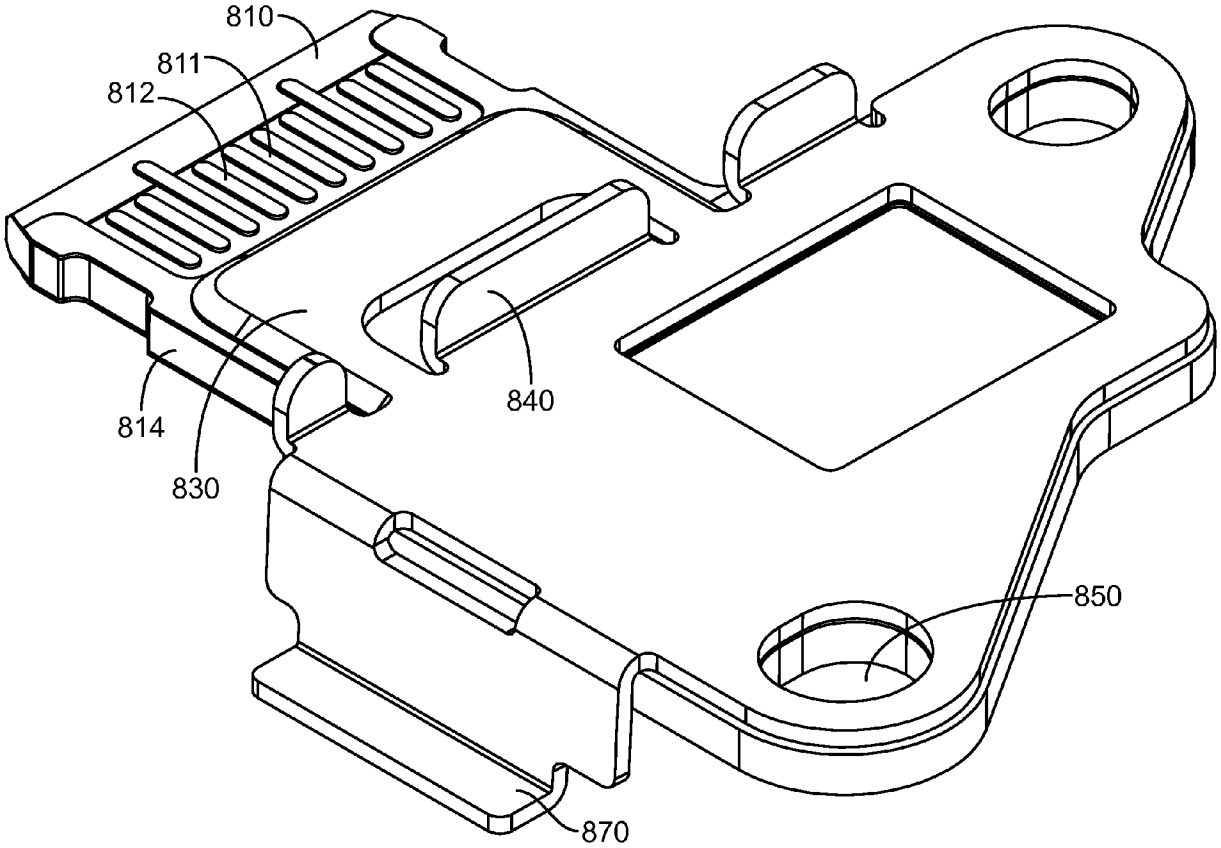
FIG. 8 illustrates a connector receptacle tongue according to an embodiment of the present invention.

FIG. 8 illustrates a connector receptacle tongue according to an embodiment of the present invention. Tongue 810 may provide an appearance and may function in a same or similar manner as tongue 210, tongue 410, and the other tongues included herein and in other embodiments of the present invention. Tongue 810 may be formed of a printed circuit board, plastic, or other material. For example, tongue 810 may be formed using FR-4 printed circuit board material. Tongue 810 may support a number of contacts 812 on top and bottom sides of front portion 811. Side ground contacts 814 may be located at notches along sides of tongue 810. These notches may engage side ground contacts in a connector insert, as shown above.

A ground plane or ground contact 830 may cover a rear portion of tongue 810. Ground contacts 830 may include tabs 840. Tabs 840 may be bent or folded to be orthogonal to a surface of tongue 810. Ground contacts 830 may engage ground contacts in a connector insert, as shown above.

One or more openings 850 in the tongue structure 810 may be included. Openings 850 may accept fasteners. Openings 850 may have a relatively flat edge facing a front of tongue 810. This flatter edge may give openings 850 a slightly D-shaped appearance. This edge may allow a tongue to move laterally a distance, for example approximately 0.1 mm, relative to the fasteners without changing the depth of tongue 810 in a device enclosure in order to reduce wear and the chance of damage to tongue 810 during insertion of a connector insert.

Various structures or fasteners may be placed in openings 852 help secure tongue 810 in place. Specifically, grommets or gaskets may fit around tongue 810 and between tabs 840 and a back side of a device enclosure opening. Fasteners may be placed in openings 850 and may provide a force compressing these gaskets in order to hold on to tongue 810 in place.

In various embodiments the present invention, an opening, such as opening 850, may be formed in tongue 810. A fastener, such as a screw, rod, post, or other structure may be inserted into opening 850 of tongue 810. This fastener, rod, or post may be attached to or formed as part of a device enclosure, a printed circuit board located inside a device enclosure, or other structure in, or associated with, the device enclosure.

Again, gaskets or grommets may be used, for example around tongue 810. These gaskets and grommets may be flexible such that tongue 810 may move relative to a device enclosure. For example, flexible gaskets or grommets may allow tongue 810 to move in a device enclosure during the insertion of a connector insert. This may help to relieve stress on tongue 810 during insertion, thereby helping to prevent damage. The flexible gaskets or grommets may also allow tongue 810 to move in forward, up, down, side to side, pitch, yaw, and roll directions during the insertion and extraction of a connector insert. Backward movement may be possible in various embodiments of the present invention, or backward movement may be limited by other structures, such as fasteners in openings 850. Again, this movement may protect tongue 810 during insertion, particularly during non-direct insertions, such as when the connector insert is inserted at a tilted or skewed angle. These gaskets or grommets may also include self-aligning features such that the tongue may reset back to an original position once such stress or force is removed. These gaskets or grommets may further be conductive to allow ground connections between ground contacts 830 and tabs 840 on tongue 810 and the device enclosure or other structures.

Figure 9:
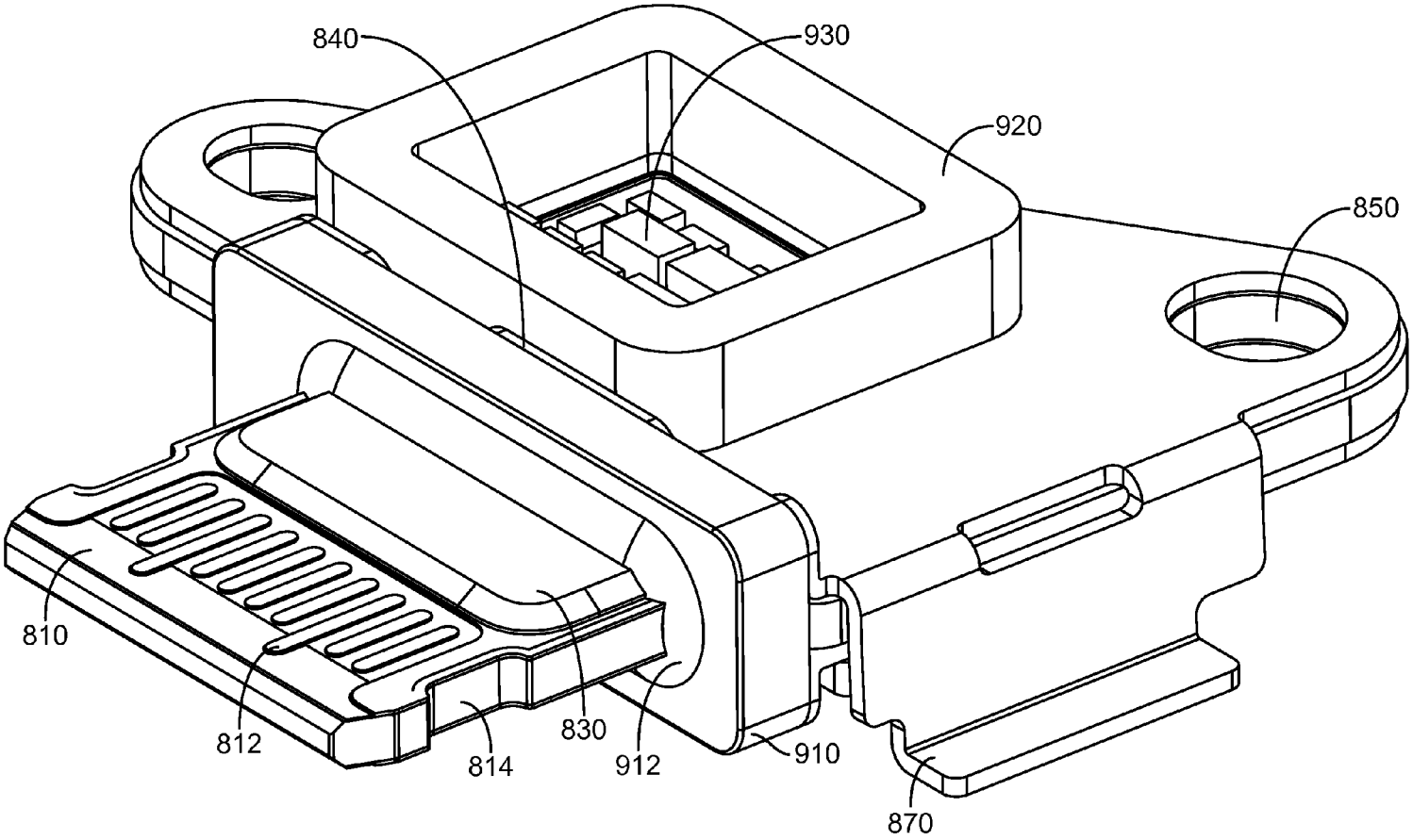
FIG. 9 illustrates the tongue of FIG. 8 having included grommets or gaskets according to an embodiment of the present invention.

FIG. 9 illustrates the tongue of FIG. 8 having included grommets or gaskets according to an embodiment of the present invention. In this figure, grommet or gasket 910 may been fit around tongue 810 and may be located against tabs 840. Grommet or gasket 910 may be conductive in order to form electrical pathways between ground contact 830 and tabs 840 and a device enclosure. Grommet or gasket 910 may include a tapered front edge 912. This tapered edge 912 may help to fill a gap between ground contact 830 and an opening in a device enclosure. This conical or tapered front edge 912 may also provide a self-centering or self-alignment feature such that tongue 810 is realigned in an opening of a device enclosure once a connector insert is removed.

A second optional grommet or gasket 920 may be included. Optional gasket 920 may be located between tongue 810 and a top inside surface of a device enclosure. Grommet or gasket 920 may surround a number of mechanical or electrical components or devices 930. Mechanical or electrical components or devices 930 may be located in an opening in a ground plane on top of tongue 810. Grommet or gasket 920 may be conductive and form an electrical connection between a ground plane on tongue 810 and a device enclosure or other structure. Grommet or gasket 920 may thus provide an amount of shielding for mechanical or electrical components or devices 930.

As before, tongue 810 may support a number of contacts 812. Tongue 810 may include side ground contacts 814 and ground contacts 830. Openings 850 may accept fasteners used to secure tongue 810 to a device enclosure. Bracket 870 may also be used to secure tongue 810 in place.

Figure 10:
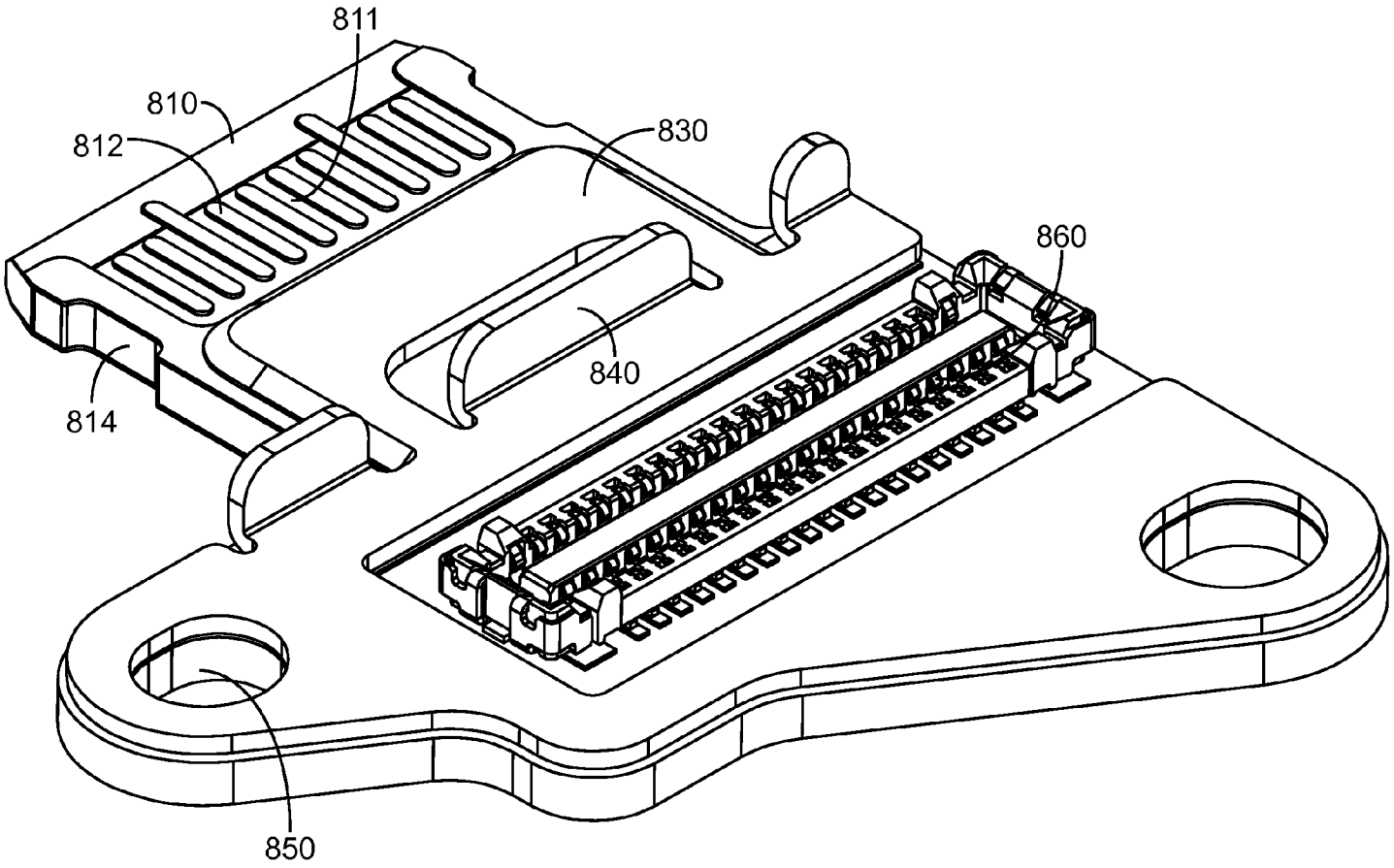
FIG. 10 illustrates an underside of the tongue of FIG. 8.

FIG. 10 illustrates an underside of the tongue of FIG. 8. As before, tongue 810 may support a number of contacts 812 and side ground contacts 814 on front portion 811. An upper ground contact 830 may cover a rear portion of tongue 810. Ground contacts 830 may include tabs 840. Connector 860 may be included to form connections between contacts 812 and components 930 on tongue 810 and a flexible circuit board or other conduit. That is, contacts of connector 860 may be connected via traces in or on tongue 810 to contacts 812 and one or more components 930. As before, one or more openings 850 may be located in a rear of tongue 810.

In various embodiments of the present invention, tongue 810 may include various plated areas. For example, contacts 812 may be formed using a hard gold plating, such as an electrolytic gold. This may improve the durability and longevity of contacts 812 while providing a low contact resistance. Contacts in connector 860 and other portions of tongue 810, such a ground planes on a top and bottom of tongue 810, may be formed or plated using an electroless nickel immersion gold material, which may be known as ENIG. This may provide a good contact having less gold to avoid the contacts from being too brittle. Side ground contacts 814 may be plated with palladium nickel (PdNi.), which is a durable material. In still other embodiments of the present invention, contacts 812 may also be formed using palladium nickel to reduce the number of plating steps used to form tongue 810.

Figure 11:
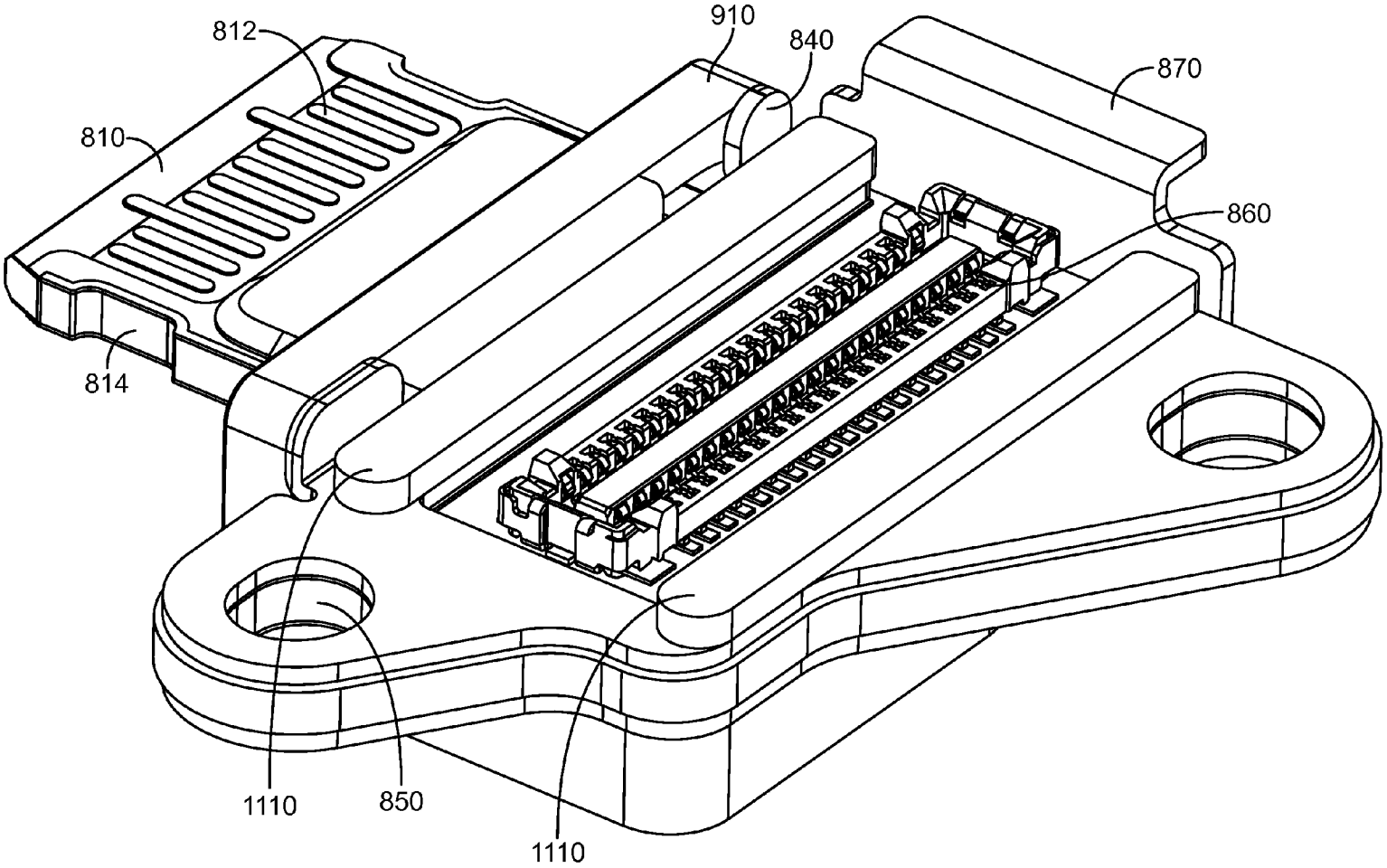
FIG. 11 illustrates and underside view of the tongue of FIG. 8 having included grommets or gaskets according to an embodiment of the present invention.

FIG. 11 illustrates and underside view of the tongue of FIG. 8 having included grommets or gaskets according to an embodiment of the present invention. In this example, gasket or grommet 910 may be fit around tongue 810 and may be located against tabs 840. Optional gasket strips or grounding features 1110 may be located on the underside of tongue 810. These optional gasket strips or grounding features 1110 may act as spacers between tongue 810 and a bottom inside surface of a device enclosure. They may also provide an electrical connection between a ground plane on the bottom of tongue 810 and the device enclosure or other structure.

Figure 12:
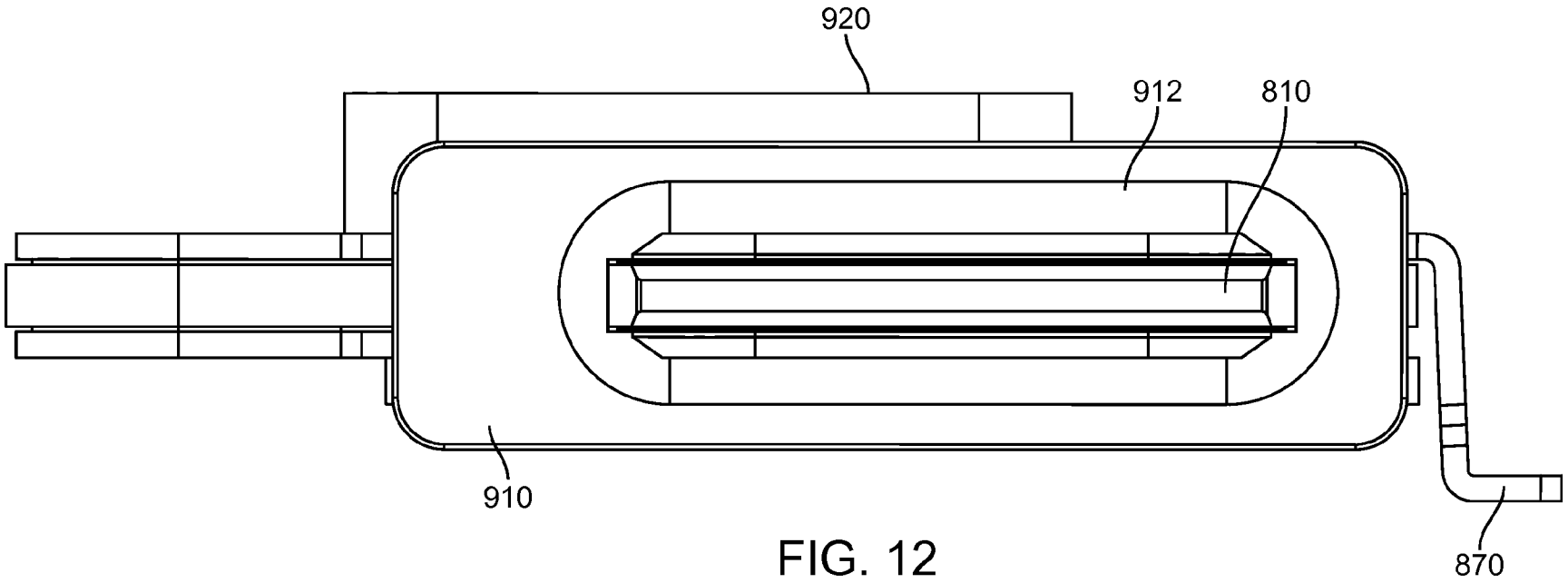
FIG. 12 illustrates a front view of the tongue of FIG. 8.

FIG. 12 illustrates a front view of the tongue of FIG. 8. In this example, tongue 810 may be surrounded by grommet or gasket 910. Grommet or gasket 910 may include a front tapered portion 912. An optional gasket or grommet 920 may reside on a top of tongue 810. Bracket 870 may also be included. Bracket 870 may fit with the device enclosure to help secure tongue 810 in place.

Figure 13:
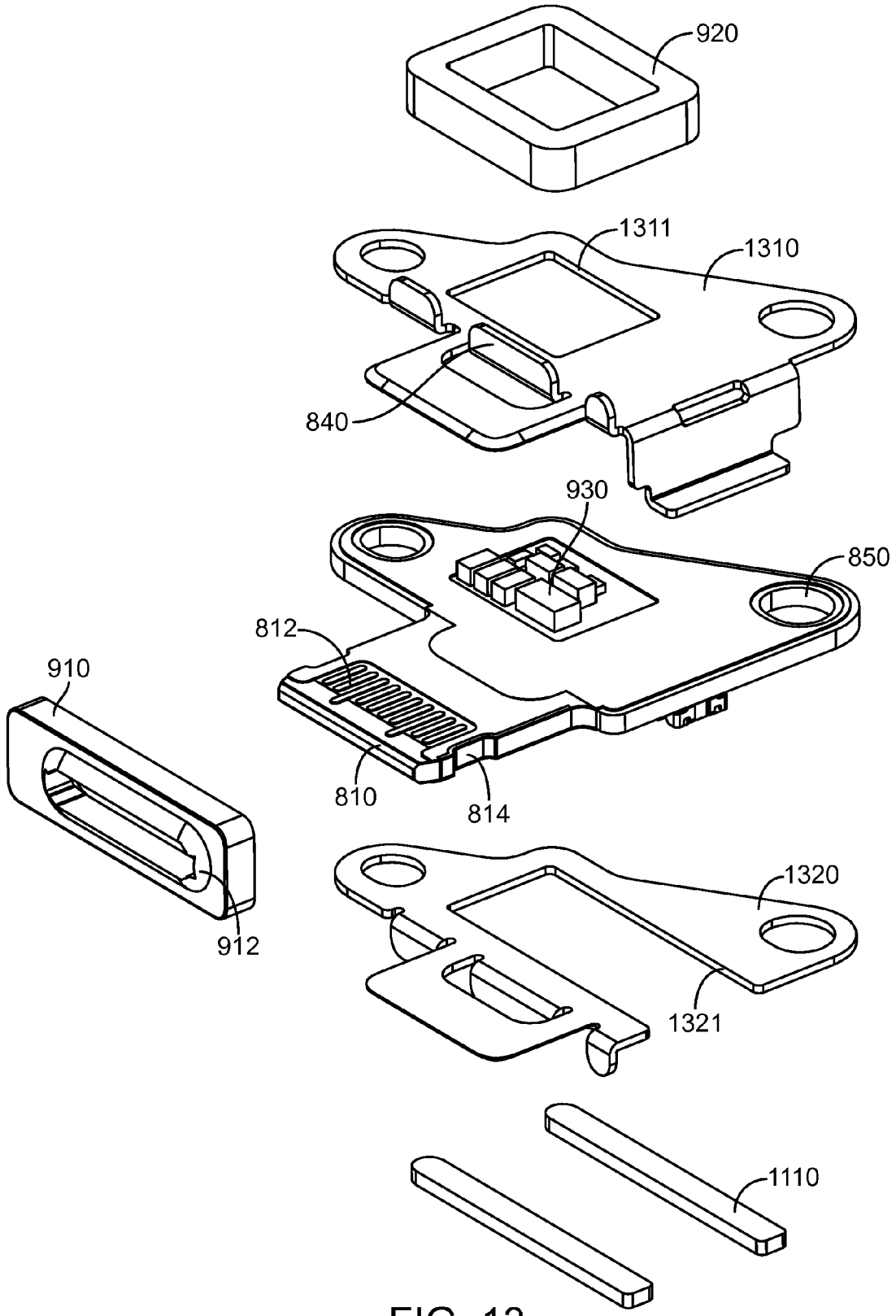
FIG. 13 illustrates an exploded view of the tongue of FIG. 8.

FIG. 13 illustrates an exploded view of the tongue of FIG. 8. A tongue 810 may be formed of a portion of a printed circuit board, such as an FR-4 or other type of printed circuit board. Tongue 810 may support a number of contacts 812 and have side notches 814 for receiving retention features on a connector insert. A number of electrical components 930 may be placed on a top side of tongue 810. Tongue 810 may further include openings 850 for accepting fasteners. Ground planes 1310 and 1320 may be located on a top and bottom side of tongue 810. Ground plane 1310 may have opening 1311 to avoid components 930. Ground plane 1320 may have notch or opening 1321 to avoid connector 860. Ground planes 1310 and 1320 may be formed by plating, metal-injection molding, from sheet metal, or in other ways. Ground planes 1310 and 1320 may provide shielding for traces in tongue 810. Ground planes 1310 and 1320 may also provide mechanical reinforcement for tongue 810. Ground planes 1310 and 1320 may include tabs 840. Grommet or gasket 910 may slide over ground planes 1310 and 1320 and tongue 810 and rest against tabs 840. Grommet or gasket 910 may include a front tapered portion 912. Optional spacers or gaskets 920 and 1110 may be included as described above. These optional gasket strips or grounding features 920 and 1110 may act as spacers between tongue 810 and a top and bottom inside surface of a device enclosure. They may also provide an electrical connection between ground planes 1310 and 1320 on tongue 810 and the device enclosure or other structure.

Again, tongue 810 may be formed of a printed circuit board. Typically, printed circuit boards are not well controlled for their color. This may lead to a large variation in color for tongues 810 among different devices. To avoid this undesirable occurrence, embodiments of the present invention may provide a tongue 810 having a leading edge that is a covered with an ink or otherwise given a uniform color. An example is shown in the following figure.

Figure 14:
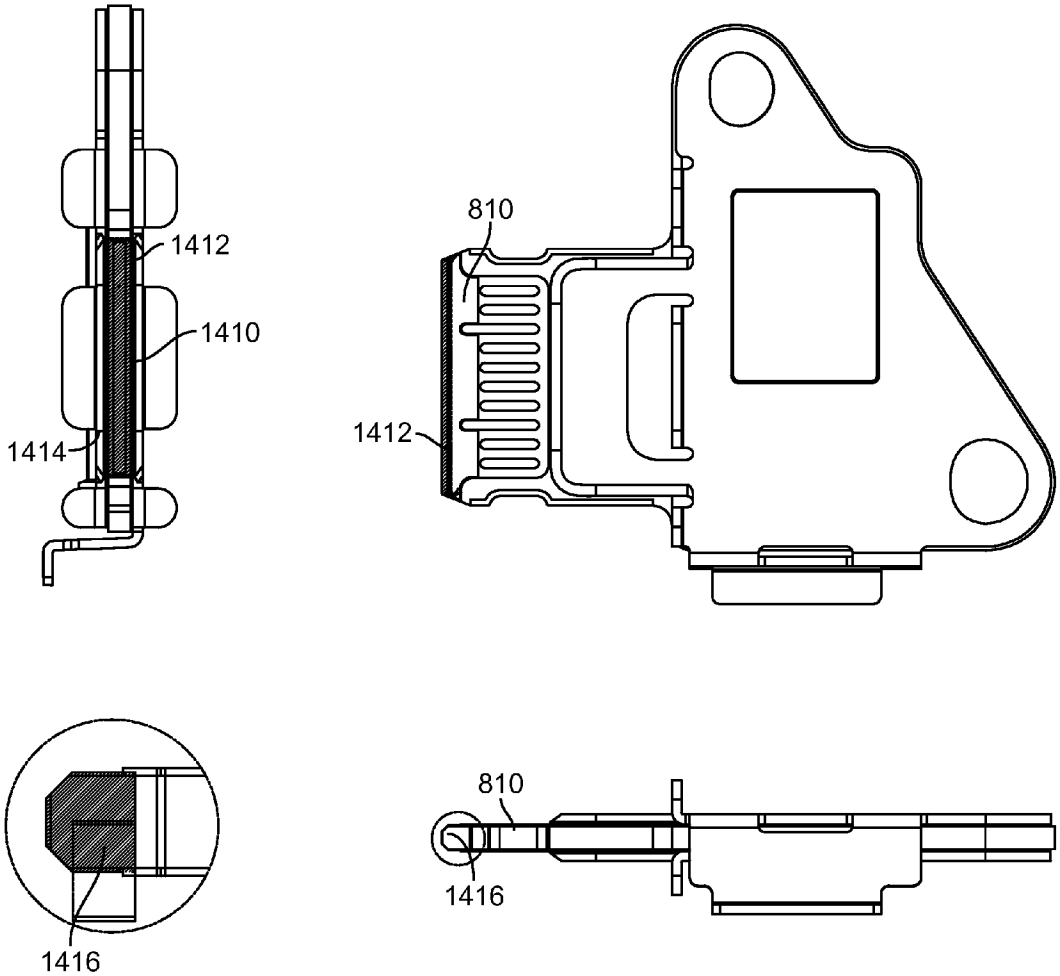
FIG. 14 illustrates a tongue having surfaces to be given a uniform color in an embodiment of the present invention.

FIG. 14 illustrates a tongue having surfaces to be given a uniform color in an embodiment of the present invention. Tongue 810 may include a leading edge 1410. Leading edge 1410 may include chamfered surfaces 1412 and 1414. In an embodiment of the present invention, surfaces 1410, 1412, and 1414 may be given a uniform color. Furthermore, leading portions of sides 1416 may also be given the same color. In this way, when a user observes the connector receptacle, a uniform appearance is provided at the front surface of the connector receptacle tongue. In various embodiments of the present invention, this coloration may be done using ink or other substance. In one example, an epoxy resin that includes ink may be applied to these surfaces. In various embodiments of the present invention, this epoxy resin may be applied using pad printing. In still other embodiments the present invention, laser printing, ink jet printing, or other technique may be used to provide this coloration. Where epoxy resin is used, it may have a thickness between 1 and 20 microns, or approximately 5 to 10 microns.

Figure 15:
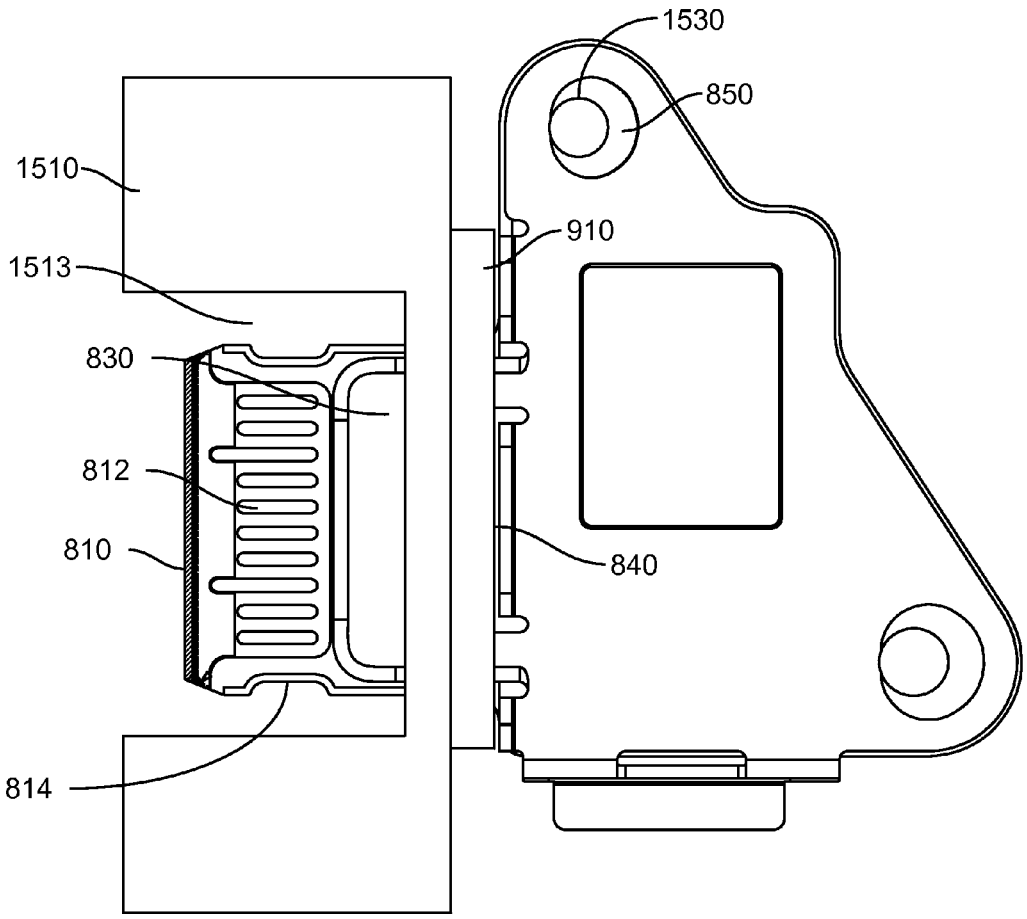
FIG. 15 illustrates a top view of the tongue of FIG. 8 in a device enclosure according to an embodiment of the present invention.

FIG. 15 illustrates a top view of the tongue of FIG. 8 in a device enclosure according to an embodiment of the present invention. In this example, tongue 810 may be located in an opening or recess 1513 in device enclosure 1510. As before, tongue 810 may support a number of contacts 812 and ground contacts 830. Ground contacts 830 may include tabs 840. A grommet, gasket, or other material 910 may be located between a rear of device enclosure 1510 and tabs 840. Screws, Rod, or other fasteners 1530 may be located in openings 850 in tongue 810. These structures may apply a force pushing tabs 840 towards the rear of device enclosure 1510. This force may compress and hold grommets or gaskets 910 in place between tabs 840 and a rear of device enclosure 1510. In various embodiments of the present invention, gaskets may be used at least partially around screws 1530, or these gaskets 910 may be absent.

Again, opening 850 may have a somewhat flattened front edge contacting fastener 1530. This may allow tongue 810 to move laterally when a force acts on tongue 810, even though fasteners 1530 may limit the amount that tongue 810 can move in a backward direction into the device enclosure. This lateral movement may absorb some insertion force and reduce wear and decrease the chance of damage to tongue 810 during insertion of a connector insert. This arrangement may also allow tongue 810 to move up and down and in a twisting direction in order to further decrease wear and the chance of damage to tongue 810 during insertion of a connector insert.

In various embodiments of the present invention, these gaskets or grommets 910 may be conductive. By forming these gaskets or grommets 910 of a conductive material, an additional ground path may be provided.

In several included examples, a connector receptacle may be formed primarily of a tongue in a recess or opening of a device enclosure. More details of these structures can be found in co-pending U.S. patent application Ser. No. 14/543,748, filed Nov. 17, 2014, titled CONNECTOR RECEPTACLE HAVING A TONGUE, which is incorporated by reference.

Figure 16:
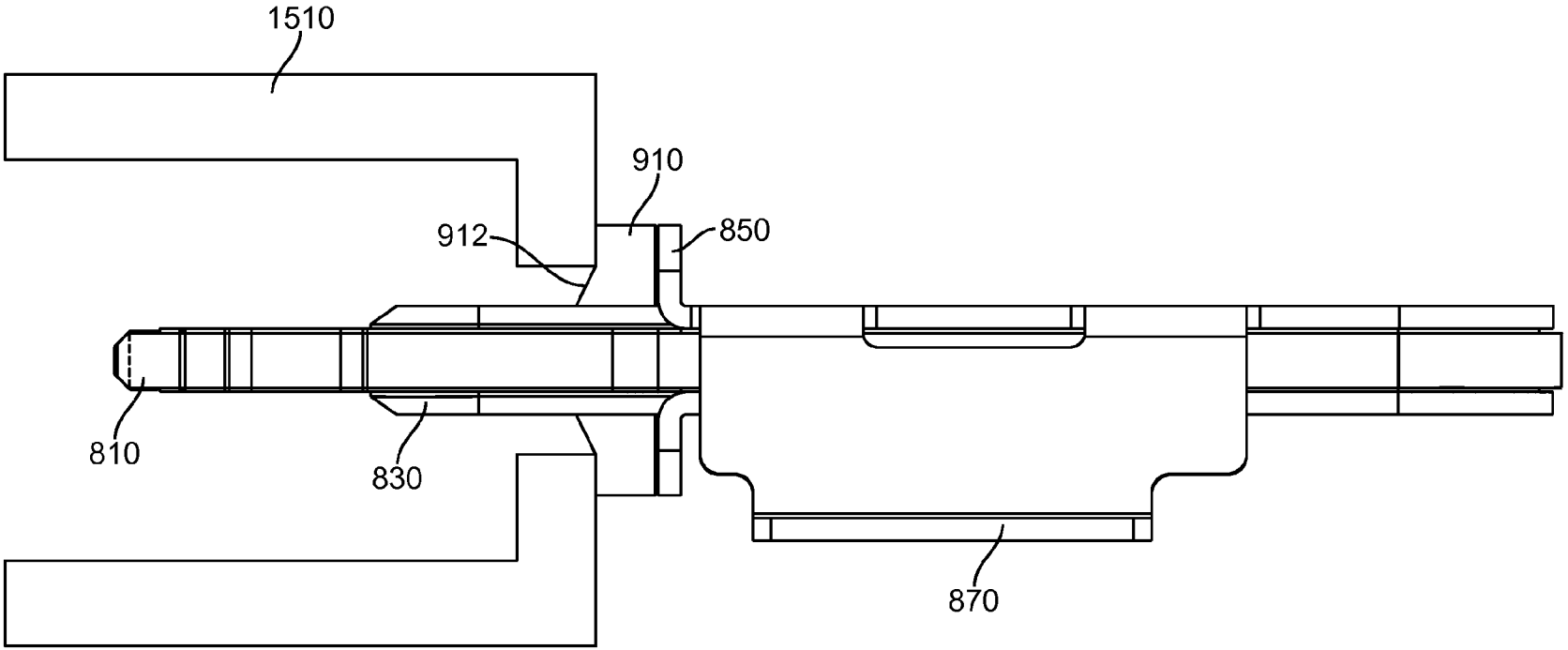
FIG. 16 illustrates a side view of the tongue of FIG. 8 in a device enclosure according to an embodiment of the present invention.

FIG. 16 illustrates a side view of the tongue of FIG. 8 in a device enclosure according to an embodiment of the present invention. In this example, tongue 810 is located in an opening in device enclosure 1510. As before, a gasket 910 may be located between tabs 840 and a rear of device housing 1510. Gasket 910 may provide a seal to prevent the ingress of liquid, moisture, dust, or other matter into the device enclosure 1510.

In this way, tongue 810 may be free to move forward, up and down, left or right, and in a pitch, yaw, or roll motion relative to device enclosure 1510. Backward motion may be limited by fasteners 1530 in openings 850, but may be more readily allowed, for example where fasteners 1530 are surrounded by grommets or gaskets in openings 850. This permitted movement may help to prevent damage to tongue 810 during the insertion or extraction of a connector plug into or out of the connector receptacle.

These connector receptacles may be formed or assembled in different ways. Tongue 810 may be inserted through opening 1512 in enclosure 1510 into opening or recess 1513. Opening 1512 may be a slot in a back side of the receptacle opening or recess 1513. In other embodiments of the present invention, the back side of the receptacle opening may be a separate piece that is held in place by forces exerted by screws 1530 on gasket 910. In this case the back side may be a bracket attached to tongue 810.

Figure 17:
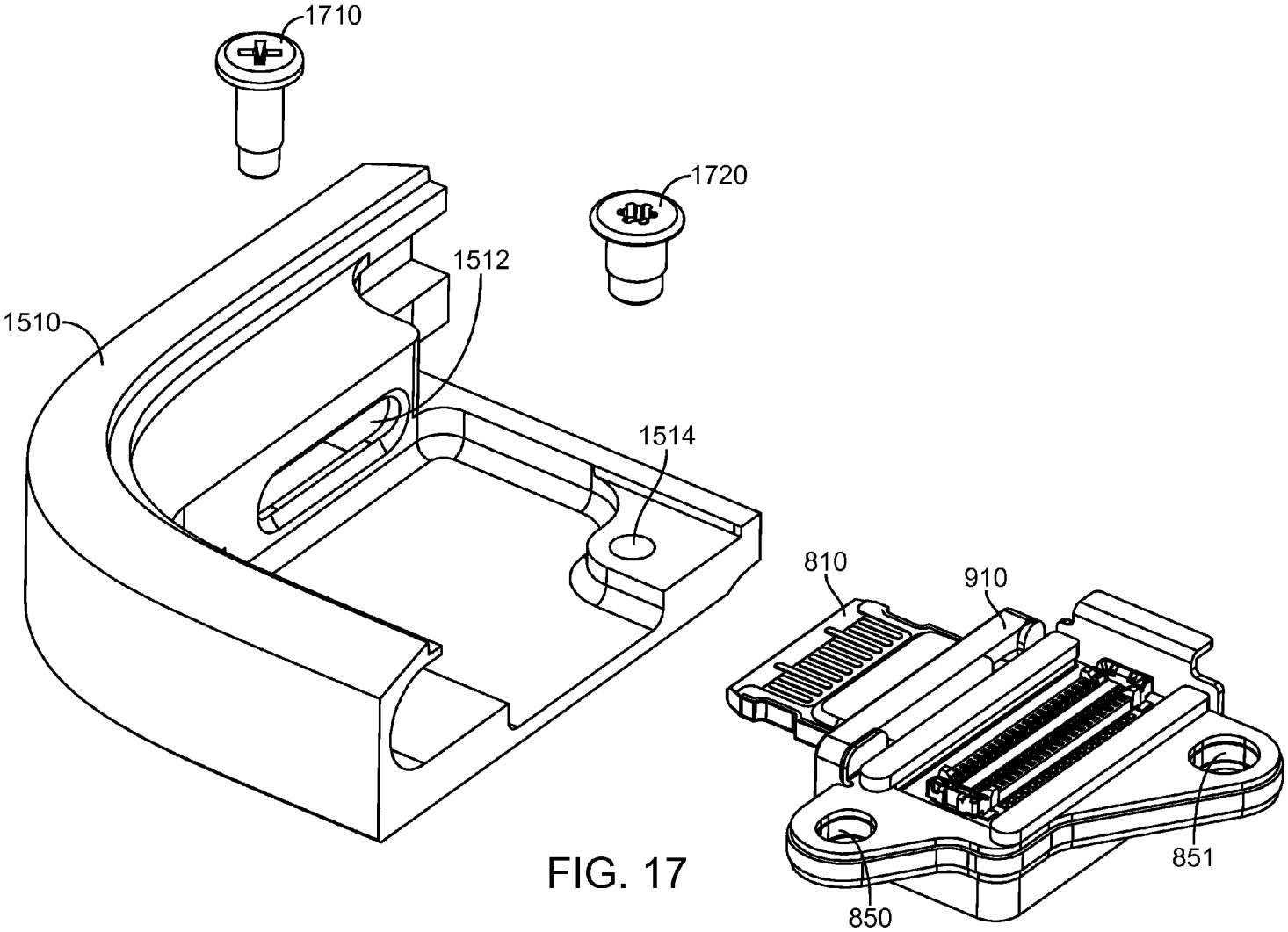
FIG. 17 illustrates a tongue and a portion of a device enclosure according to an embodiment of the present invention.

FIG. 17 illustrates a tongue and a portion of a device enclosure according to an embodiment of the present invention. This example illustrates a portion of a device enclosure 1510 and tongue 810. During assembly, tongue 810 may be slid through opening 1512 in device enclosure 1510 into recess or opening 1513 in device enclosure 1510. Fastener 1720 may be inserted through opening 851 in tongue 810 and into opening 1514 in device enclosure 1510. Fastener 1710 may be inserted through opening 850 in tongue 810 into a corresponding opening in device enclosure 1510.

Grommet or gasket 910 may be located between an inside surface of device enclosure 1510 and tabs 840. During assembly, a small forward pressure may be applied to tongue 810. Fasteners 1710 and 1720 may be passed through openings 850 and 851 and into openings in device enclosure 1510. Tongue 810 may then be released. Grommet or gasket 910 may be slightly compressed under pressure and may provide a force against fasteners 1710 and 1720 thereby holding tongue 810 in place.

In this example, it may be undesirable to confuse fasteners 1710 and 1720 during assembly of an electronic device housing tongue 810. Accordingly, fasteners 1710 and 1720 may have top side openings to accept different non-compatible tools. That is, a tool used on fasteners 1710 may not be useful in turning fasteners 1720, while a tool for fastener 1720 would not be useful for fastener 1710. In this way, fastener 1720 is unlikely to be mistakenly inserted into an opening intended to receive fastener 1710, and fastener 1710 is unlikely to be mistakenly inserted into an opening intended to receive fastener 1720. A thickness of body portions of fasteners 1710 and 1720 may also be varied in order to reduce the chance of confusion during assembly.

Figure 18:
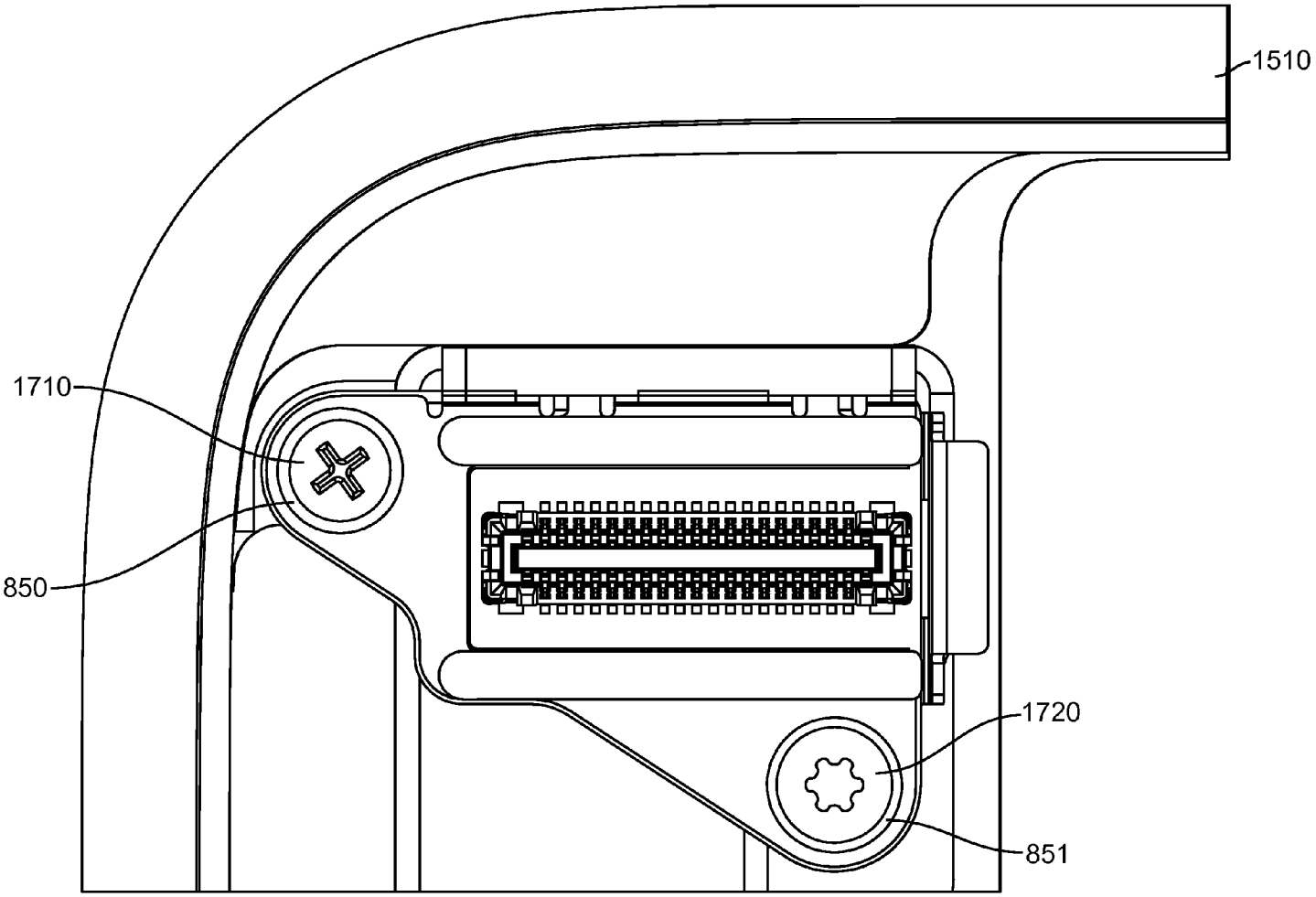
FIG. 18 illustrates a tongue and a portion of a device enclosure according to an embodiment of the present invention.

FIG. 18 illustrates a tongue and a portion of a device enclosure according to an embodiment of the present invention. In this example, tongue 18 may be inserted in device enclosure 1510. Fasteners 1710 and 1720 may be located in openings 850 and 851.

Figure 19:
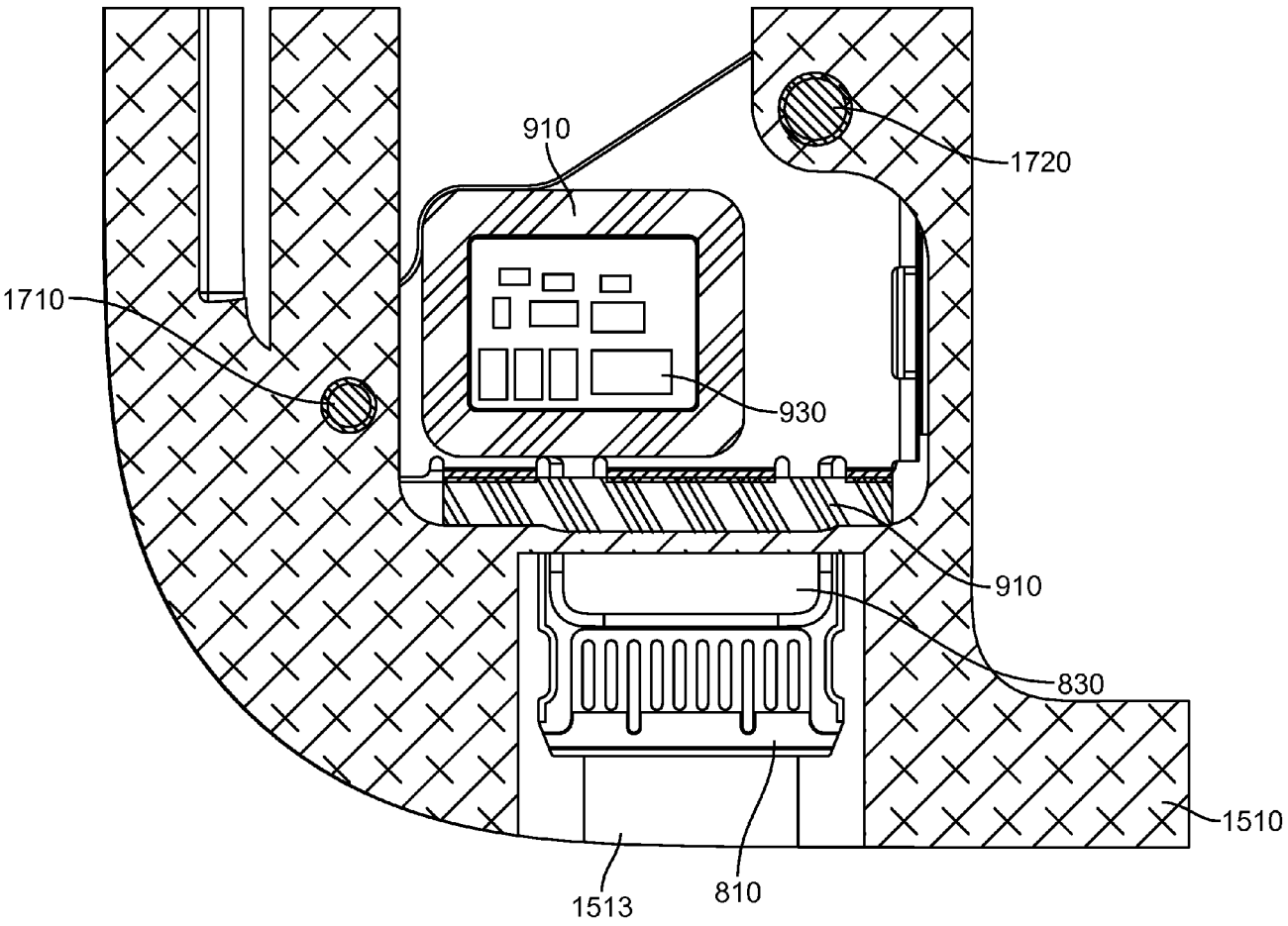
FIG. 19 illustrates a cutaway view of a tongue and a portion of a device enclosure according to an embodiment of the present invention.

FIG. 19 illustrates a cutaway view of a tongue and a portion of a device enclosure according to an embodiment of the present invention. In this example, tongue 810 may be located in an opening in the device enclosure 1510. As before, fasteners 1710 and 1720, as well as grommet or gasket 910 may be used to secure tongue 810 in device enclosure 1510.

Figure 20:
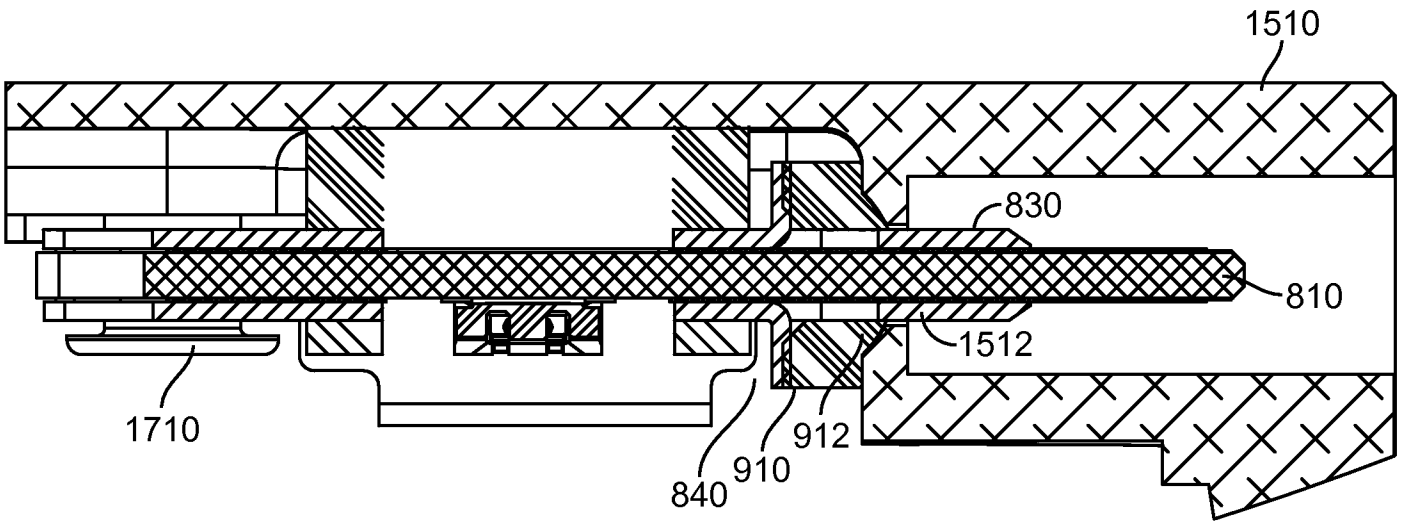
FIG. 20 illustrates a side view of a tongue and a portion of a device enclosure according to an embodiment of the present invention.

FIG. 20 illustrates a side view of a tongue and a portion of a device enclosure according to an embodiment of the present invention. Again, tongue 810 may pass through opening 1512 in device enclosure 1510. Grommet or gasket 910 may be located between tabs 840 and device enclosure 1510. Grommet or gasket 910 may have front tapered edge 912, which may help to fill opening 1512. Front tapered edge 912 may help to prevent water or other unwanted ingress into the device by forming a seal between ground contact 830 and an inside edge of opening 1512 in device enclosure 1510.

Again, fastener 1710 may provide a slight forward pressure on tongue 810 such that grommet or gasket 910 is at least slightly compressed. This compression may help secure tongue 810 in place and further reduce water or other unwanted ingress into the device.

Grommet or gasket 910 may include a tapered front edge 912. This tapered edge 912 may help to fill a gap between ground contact 830 and opening 1512 in device enclosure 1510. This conical or tapered front edge 912 may also provide a self-centering or self-alignment feature such that tongue 810 is realigned in opening 1512 of a device enclosure 1510 once a connector insert is removed. Grommet or gasket 910 may also provide an electrical path for grounding between ground contact 830 and tabs 840 on tongue 810 and the device enclosure.

In various embodiments of the present invention including the examples shown, contacts, ground contacts, metallic pieces including metallic center pieces, and other conductive portions of a connector receptacle, such as the shell or shield, may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions may be formed using injection or other molding, 3-D printing, machining, or other manufacturing process. The nonconductive portions may be formed of silicon or silicone, rubber, hard rubber, plastic, nylon, liquid-crystal polymers (LCPs), or other nonconductive material or combination of materials. Again, the gaskets or grommets may be formed of various materials including, but not limited to, elastomers with low compression set. This may help to ensure consistent performance over the life of the connector receptacle. In specific embodiments of the present invention, the elastomers used may be silicone or urethane. The printed circuit boards used may be formed of FR-4 or other material. Various printed circuit boards shown and in other embodiments of the present invention may be replaced by other substrates, such as flexible circuit boards.

Embodiments of the present invention may provide connector receptacles that may be located in and may connect to various types of devices, such as portable computing devices, tablet computers, desktop computers, laptops, all-in-one computers, cell phones, smart phones, media phones, storage devices, portable media players, navigation systems, monitors, power supplies, adapters, remote control devices, chargers, and other devices. These connector receptacles may provide pathways for signals and power compliant with various standards such as Universal Serial Bus (USB), a High-Definition Multimedia Interface (HDMI), Digital Visual Interface (DVI), power, Ethernet, DisplayPort, Thunderbolt, Lightning and other types of standard and non-standard interfaces that have been developed, are being developed, or will be developed in the future.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector receptacle comprising:

a tongue supporting a first plurality of contacts;

a housing, wherein the housing is an enclosure for an electronic device that includes the connector receptacle; and a first flexible gasket between the tongue and the housing, such that the tongue may move relative to the housing, wherein the tongue includes an opening, where a second flexible gasket is located in the opening, and wherein the second flexible gasket is arranged to accept a first structure.

2. The connector receptacle of claim 1 wherein the first structure is a rod attached to a printed circuit board in the electronic device.

3. The connector receptacle of claim 1 wherein the first structure is a fastener attached to the enclosure.

4. The connector receptacle of claim 1 wherein the first structure is a rod formed as part of the enclosure.

5. The connector receptacle of claim 1 wherein the first flexible gasket is formed of an elastomer.

6. The connector receptacle of claim 5 wherein the elastomer is silicone.

7. The connector receptacle of claim 5 wherein the elastomer is urethane.

8. The connector receptacle of claim 5 wherein the tongue extends through an opening in the enclosure, and the first flexible gasket has a tapered front edge such that the tapered front edge fits in the opening of the enclosure.

9. A connector receptacle comprising:

a tongue having a front portion supporting a plurality of contacts;

a first ground plane attached to a top of the tongue, the first ground plane including a first tab orthogonal to the top of the tongue;

a second ground plane attached to a bottom of the tongue, the second ground plane including a second tab orthogonal to the bottom of the tongue; and a flexible gasket around the tongue and against the first tab and the second tab.

10. The connector receptacle of claim 9 further comprising:

a device enclosure having an opening, the opening providing passage for the front portion of the tongue, where the flexible gasket is around the tongue and between the opening in the device enclosure and the first and second tabs.

11. The connector receptacle of claim 10 wherein the gasket has a tapered front edge such that the tapered front edge fits in the opening of the device enclosure.

12. The connector receptacle of claim 11 wherein the tapered front edge provides a self-alignment feature such that the tongue returns to an original position after a connector insert has been removed from the connector receptacle.

13. The connector receptacle of claim 10 wherein the tongue comprises an opening for a fastener.

14. The connector receptacle of claim 13 wherein the fastener is inserted through the opening in the tongue and into the device enclosure.

15. The connector receptacle of claim 14 wherein the fastener provides a compressive force on the flexible gasket.

16. A connector receptacle comprising:

a tongue having a front portion supporting a plurality of contacts;

a first ground plane on a top of the tongue;

a second ground plane on a bottom of the tongue;

a plurality of electronic components on the top of the tongue in an opening in the first ground plane; and a connector having contacts, the contacts attached to the plurality of contacts on the tongue front portion and the plurality of electronic components.

17. The connector receptacle of claim 16 wherein the first ground plane includes a first tab orthogonal to the top of the tongue and the second ground plane includes a second tab orthogonal to the bottom of the tongue.

18. The connector receptacle of claim 17 further comprising a first flexible gasket around the tongue and against the first tab and the second tab.

19. The connector receptacle of claim 18 further comprising a second flexible gasket around the plurality of electronic components.

20. The connector receptacle of claim 19 wherein the connector is in an opening in the second ground plane on the bottom of the tongue.

* * * * *